US010287770B2

(12) United States Patent
Hodson et al.

(10) Patent No.: US 10,287,770 B2
(45) Date of Patent: May 14, 2019

(54) SYSTEMS, METHODS, APPARATUS, AND COMPOSITIONS FOR BUILDING MATERIALS AND CONSTRUCTION

(71) Applicant: Earth Technologies USA Limited, Causeway Bay (HK)

(72) Inventors: Simon Hodson, Santa Barbara, CA (US); Jonathan Hodson, Santa Barbara, CA (US)

(73) Assignee: OMNIS ADVANCED TECHNOLOGIES, Santa Barbara, CA (US)

( * ) Notice: Subject to any disclaimer, the term of this patent is extended or adjusted under 35 U.S.C. 154(b) by 0 days.

(21) Appl. No.: 15/339,375

(22) Filed: Oct. 31, 2016

(65) Prior Publication Data

US 2017/0121961 A1 May 4, 2017

Related U.S. Application Data

(60) Provisional application No. 62/251,022, filed on Nov. 4, 2015, provisional application No. 62/271,937, filed
(Continued)

(51) Int. Cl.
*E04B 1/14* (2006.01)
*E04B 1/343* (2006.01)
(Continued)

(52) U.S. Cl.
CPC ..... *E04B 1/34321* (2013.01); *E04B 1/34384* (2013.01); *E04C 2/288* (2013.01);
(Continued)

(58) Field of Classification Search
CPC ..... E04C 2/2885; E04C 2/049; E04C 2/288; E04C 1/41; E04C 2/296; E04C 1/40; E04C 2/044; E04B 7/22; E04B 1/14
See application file for complete search history.

(56) References Cited

U.S. PATENT DOCUMENTS 3,372,519 A 3/1968 Russsell
3,984,957 A 10/1976 Piazza
(Continued)

FOREIGN PATENT DOCUMENTS

AU 2003101087 A4 3/2008
EP 1069090 A1 1/2001
(Continued)

OTHER PUBLICATIONS

Cam Lock Structural Insulated Panel Camlock Panels, http://singcore.com/news/cam-lock-structural-insulated-panel-camlock-panels (4 pages).
(Continued)

*Primary Examiner* — Gisele D Ford
(74) *Attorney, Agent, or Firm* — Kirton McConkie; Evan R. Witt

(57) ABSTRACT

A structural insulated building unit is provided for constructing a building. The structural insulated building unit includes an insulating core, first and second cementitious panels, and a connecting portion. The insulating core is defined by multiple sides and opposing first and second faces. The first and second cementitious panels are coupled to the first and second faces of the insulating core. The connecting portion is provided on one of the sides of the insulating core, and aligns the structural insulated building unit with an adjacent structural insulated building unit having a complementary connecting portion when constructing a building.

16 Claims, 26 Drawing Sheets

Related U.S. Application Data on Dec. 28, 2015, provisional application No. 62/292,080, filed on Feb. 5, 2016.

(51) Int. Cl.

| | |
|---|---|
| ***E04C 2/288*** | (2006.01) |
| ***E04H 1/00*** | (2006.01) |
| ***E04C 2/38*** | (2006.01) |
| *E04B 1/61* | (2006.01) |
| *E04B 1/80* | (2006.01) |

(52) U.S. Cl.

CPC ..... *E04C 2/2885* (2013.01); *E04C 2/382* (2013.01); *E04H 1/005* (2013.01); *E04B 1/14* (2013.01); *E04B 1/6125* (2013.01); *E04B 1/6183* (2013.01); *E04B 1/80* (2013.01); *E04B 2001/6195* (2013.01)

(56) References Cited

U.S. PATENT DOCUMENTS

| | | | | |
|---|---|---|---|---|
| 4,021,258 | A | 5/1977 | Uogaeshi | |
| 4,232,494 | A | 11/1980 | Bauch et al. | |
| 4,614,071 | A * | 9/1986 | Sams | E04C 1/41 52/309.12 |
| 4,833,855 | A | 5/1989 | Winter, IV | |
| 4,865,894 | A | 9/1989 | Shubow | |
| 4,907,383 | A * | 3/1990 | Winter, IV | E04C 2/288 52/309.9 |
| 5,195,282 | A | 3/1993 | Campbell | |
| 5,244,726 | A | 9/1993 | Laney et al. | |
| 5,509,242 | A | 4/1996 | Rechsteiner et al. | |
| 5,519,971 | A | 5/1996 | Ramirez | |
| 5,758,463 | A * | 6/1998 | Mancini, Jr. | E04C 2/384 52/309.12 |
| 5,842,314 | A | 12/1998 | Porter | |
| 5,921,046 | A | 7/1999 | Hammond, Jr. | |
| 5,927,032 | A * | 7/1999 | Record | E04C 2/292 52/284 |
| 6,006,480 | A | 12/1999 | Rook | |
| 6,088,985 | A | 7/2000 | Clark | |
| 6,185,891 | B1 | 2/2001 | Moore | |
| 6,235,367 | B1 * | 5/2001 | Holmes | E04B 1/14 428/223 |
| 6,298,619 | B1 | 10/2001 | Davie | |
| 6,412,243 | B1 * | 7/2002 | Sutelan | B29C 44/12 428/182 |
| 6,564,521 | B1 * | 5/2003 | Brown | E04C 2/292 52/309.11 |
| 6,761,007 | B2 | 7/2004 | Lancelot, III et al. | |
| 6,773,500 | B1 | 8/2004 | Creamer et al. | |
| 7,107,731 | B2 | 9/2006 | Record | |
| 8,277,556 | B2 | 10/2012 | Berke et al. | |
| 8,286,399 | B2 | 10/2012 | Brown | |
| 8,381,468 | B2 | 2/2013 | Koupal | |
| 8,539,732 | B2 | 9/2013 | Leahy | |
| 8,869,492 | B2 | 10/2014 | Leahy | |
| 8,877,329 | B2 | 11/2014 | Ciuperca | |
| 8,978,333 | B2 | 3/2015 | Potter et al. | |
| 2003/0079438 | A1 | 5/2003 | Stephens et al. | |
| 2003/0089061 | A1 | 5/2003 | DeFord et al. | |
| 2004/0040239 | A1 | 3/2004 | Baillargeon | |
| 2006/0096205 | A1 * | 5/2006 | Griffin | E04C 2/296 52/309.4 |
| 2007/0044411 | A1 | 3/2007 | Meredith et al. | |
| 2007/0062143 | A1 | 3/2007 | Noushad | |
| 2007/0144093 | A1 | 6/2007 | Messenger et al. | |
| 2007/0256379 | A1 * | 11/2007 | Edwards | B32B 5/18 52/309.9 |
| 2008/0307739 | A1 | 12/2008 | Clucas | |
| 2011/0173911 | A1 * | 7/2011 | Propst | B32B 3/06 52/309.13 |
| 2011/0173925 | A1 * | 7/2011 | Brown | E04B 1/14 52/794.1 |
| 2013/0216802 | A1 | 8/2013 | Leung et al. | |
| 2013/0227902 | A1 | 9/2013 | Van Sloun et al. | |
| 2013/0326966 | A1 * | 12/2013 | Willems | E01C 5/22 52/125.4 |
| 2014/0123583 | A1 * | 5/2014 | Arriola Serrano | E04B 2/06 52/405.1 |
| 2014/0137499 | A1 | 5/2014 | Strachan | |
| 2014/0250827 | A1 * | 9/2014 | Gillman | E04C 2/38 52/745.21 |
| 2014/0260031 | A1 | 9/2014 | Salazar et al. | |
| 2015/0159376 | A1 * | 6/2015 | Biadora | E04C 1/397 52/503 |
| 2015/0218821 | A1 * | 8/2015 | Bates | E04D 3/355 52/419 |

FOREIGN PATENT DOCUMENTS

| | | | |
|---|---|---|---|
| EP | 2034102 | B1 | 10/2013 |
| FR | 2962462 | A1 | 1/2012 |
| GB | 1419924 | A | 12/1975 |
| WO | 1996000334 | A1 | 1/1996 |
| WO | 2008089414 | A1 | 7/2008 |
| WO | 2015042665 | A1 | 4/2015 |
| WO | 2015107369 | A1 | 7/2015 |
| WO | 2015128786 | A1 | 9/2015 |

OTHER PUBLICATIONS

Cement Sandwich Panels / Structural Insulated Panels (SIPs) for Prefab House, http://quacent.en.made-in-china.com/product/UoFEcfCrHtpj/China-Cement-Sandwich-Panels-Structural-Insulated-Panels-SIPs-for-Prefab-House.html (3 pages).

Flores-Johnson et al., "Structural behaviour of composite sandwich panels with plain and fibrereinforced foamed concrete cores and corrugated steel faces", Composite Structures, vol. 94, Issue 5, Apr. 2012, pp. 1555-1563 (16 pages).

High-Strength Structural Lightweight Concrete, http://www.lightconcrete.com/images/lightconcrete.pdf (38 pages).

Murus Structural Insulating Panels, http://www.murus.com/downloads/Murus-Brochure.pdf (4 pages).

ProTec® CSIP, http://www.tclear.com/products/structural-insulated-panel/protec-csip/# (1 page).

Structural Concrete Insulated Panels (SCIP), http://www.marcormasters.com/construction.html (2 pages).

Structural Insulated Panels (SIPs), https://www.wbdg.org/resources/sips.php (8 pages).

* cited by examiner

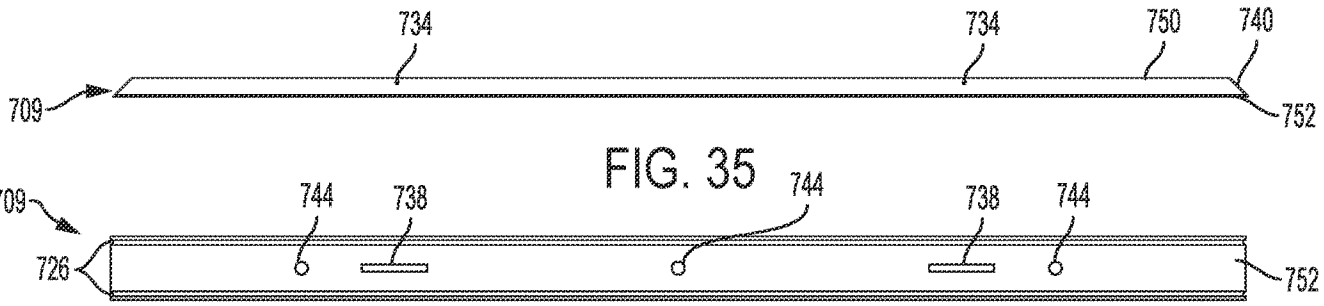
FIG. 35
FIG. 36
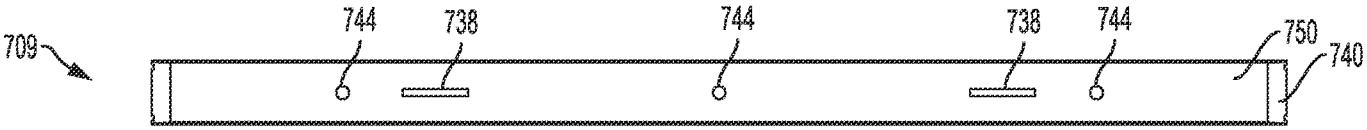
FIG. 37
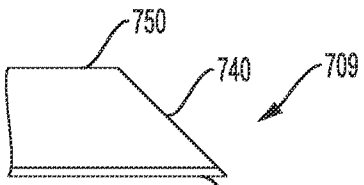
FIG. 39
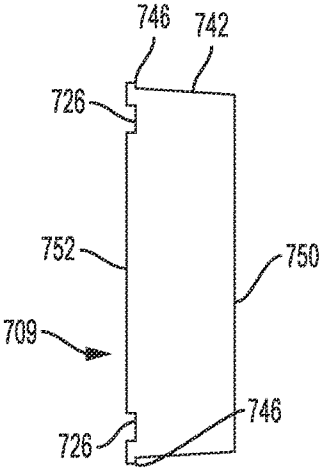
FIG. 38

SYSTEMS, METHODS, APPARATUS, AND COMPOSITIONS FOR BUILDING MATERIALS AND CONSTRUCTION

CROSS-REFERENCE TO RELATED APPLICATIONS

This application claims priority to provisional U.S. Patent Application Nos. 62/251,022, which was filed Nov. 4, 2015; 62/271,937, which was filed Dec. 28, 2015; and 62/292,080, which was filed Feb. 5, 2016, the disclosures of which are incorporated herein by reference in their entirety.

TECHNICAL FIELD

The invention relates to building materials, components, and methods of construction, and, more particularly, to non-traditional construction using a structural insulated building unit with inherent structural integrity, prefinished surfaces, and/or precision alignment, foamed concrete, composite materials and constructions, and self-sustainable buildings.

BACKGROUND

Almost half of the world's population lives in inadequate housing, including in slums and squatter settlements. Current worldwide need for low-cost, affordable housing is significant and growing. Modern utilities distributions are also inefficient and many people still do not have basic sanitation facilities. Where utilities are available, the approach to utilities has been to make it easy for the provider rather than efficient to the user. Unfortunately, traditional home construction and the building industry have not changed to address these challenges. Typical construction practices are increasingly expensive, inefficient, and require specific skilled labor.

Traditional building construction relies on various types of skilled workers to complete discrete components of a building or phases of construction, including framing, insulation, utilities, interior and exterior architectural finishes; each step separate from the other and requiring different skills. Modular building construction allows some of the assembly to be performed in a manufacturing facility off-site and once on-site the pre-built sections can be assembled into the building using traditional building methods; however, this prefab method is limited in design and still requires the same skilled workers and processes. For example, one type of pre-built component used in modular construction is the structural insulated panel (SIP). SIPs allow for insulation to be included in a panel and are constructed off-site. On-site, the SIPs are assembled into a building using traditional building methods including the use of separate structural framing with posts and beams, and with attachment using screws, nails, etc. Further steps are needed to complete the building, including providing interior and exterior finishes, and connecting utilities, for example. These conventional building techniques, including conventional SIPs, do not address or contemplate a total home building solution. Thus, inefficiencies remain in terms of speed, quality, cost, and utilities, and there is currently no high-quality, low-cost, flexible, efficient system for building construction.

What is needed is a total home building solution that is sustainable, secure, high-quality, efficient, fast and easy to construct, and economical. Housing and building construction in accordance with the principles of the present invention is based on the principles of high technology, high efficiency, and high quality. Buildings can be built on-site with local labor and no special skills and/or equipment in accordance with the principles of the invention. The inventive technology can have factory-finished interior and exterior surfaces to ensure high tolerances and high quality at the highest efficiency and lowest cost. In addition to finishes, utilities such as plumbing and electrical systems can be integrated into the building solution to reduce the need for additional time, expertise, and materials. Indeed, there can be no need for utility hook-ups. The inventive solution can include the lowest energy profiles for any and all climates as well as high seismic and fire resistance.

This better building construction can be achieved through the use of various embodiments of the invention. The inventive technology includes the use of inventive building materials, building units, and construction methods. The inventive construction method is both efficient and economical in terms of time to build, amount of complexity and discrete components needed, and skill required. Some of the building units of the invention are referred to herein as structural insulated building units (SIBUs). The SIBUs can provide inherent structural integrity to a building and can include an insulating core. The interior and exterior surfaces of the structural insulated building units can be factory-finished to simplify and shorten the construction process. Electricity can be provided via local solar, wind, or mechanical power with 12 volt electrical systems. Water and waste management systems are also available locally to enable a self-sufficient structure. Novel cementitious materials and composites of the invention can include extruded cementitious materials, fiber-reinforced concrete, and foamed concrete. The panel units incorporate the preferred structural strength, bacterial and/or fungal resistance, surface characteristics and finishes, and freeze and/or thaw resistance to achieve an inventive total home building solution.

BRIEF SUMMARY OF THE INVENTION

Embodiments of the invention address the above problems and needs in traditional building construction using a structural insulated building unit (SIBU) with an innovative jointing and assembly feature. The SIBU is suitable for use as part of a floor, wall, or ceiling of a building, for example. The SIBU can have a laminar composition and exhibit high stiffness, sound and thermal insulation, and strength compared to traditional building elements and compositions. These properties can be further exploited by creating a box beam from the laminar element. The box beam has the capability of distributing loads throughout a wall or floor, for example, rather than concentrating loads on posts and beams that are used in traditional construction. In embodiments of the invention, the units are not continuous, but can employ a connection system to align and fasten multiple units together without the need for separate columns or beams that are used in traditional construction. The improved systems, methods, apparatus, and compositions for building construction and materials of the invention enable much reduced time of construction of high quality structures with optimized lower-cost and highest-quality finishes without skilled labor requirements. With this improved construction system and materials, construction steps are reduced while maintaining precise and improved alignment of the building elements to enhance structural integrity of the resulting structure.

An embodiment of the present invention includes a structural insulated building unit for constructing a building or structure. The structural insulated building unit can include an insulating core, first and second cementitious panels, and a connecting portion. The insulating core is defined by a plurality of sides and opposing first and second faces of the insulating core. The first and second cementitious are panels coupled to the first and second faces of the insulating core, and the connecting portion is provided on one of the sides of the insulating core. The connecting portion can align the structural insulated building unit with an adjacent structural insulated building unit having a complementary connecting portion when constructing a building or structure.

In an aspect of the embodiment, the connecting portion can be a spline extending along the side of the insulating core. The connecting portion includes a three-dimensional surface facing outward from the structural insulated building unit, the three-dimensional surface being arranged for mating engagement with a three-dimensional surface on the complementary connecting portion. The mating engagement of the three-dimensional surface can align the structural insulated building unit with the adjacent structural insulated building unit in three orthogonal directions parallel to x-, y-, and z-axes. The connecting portion can further include a mounting side and a coupling side, where the mounting side is configured to couple to the side of the insulating core and the coupling side is on an opposite side of the connecting portion relative to the mounting side. The coupling side includes the three-dimensional surface. According to aspects of the embodiment, the three-dimensional surface can align the structural insulated building unit with the adjacent structural insulated building unit with precision such that the first and second cementitious panels of the structural insulated building unit and the adjacent structural insulated building unit form continuous planar surfaces across edges of adjacent first and second cementitious panels. The three-dimensional surface can include at least one of the following: at least one raised portion and at least one recessed portion.

Where the three-dimensional surface includes at least one raised portion, the at least one raised portion is configured for mating engagement with at least one recessed portion of the three-dimensional surface on the complementary connecting portion. The at least one raised portion can be tapered as the raised portion extends away from the insulating core such that the raised portion is tapered in at least one direction that is parallel to the x-axis, y-axis, and z-axis. In addition, the at least one raised portion can have an end surface that is parallel to a mating surface of the at least one recessed portion of the three-dimensional surface of the adjacent structural insulated building unit when in mating engagement with the adjacent structural insulated building unit.

Where the three-dimensional surface includes at least one recessed portion, the at least one recessed portion is configured for mating engagement with at least one raised portion of a three-dimensional surface on the adjacent structural insulated building unit. The at least one recessed portion can be tapered as the recessed portion extends toward the insulating core such that the recessed portion is tapered in at least one direction that is parallel to the x-axis, y-axis, and z-axis. In addition, the at least one recessed portion can have an end surface that is parallel to a mating surface of the at least one raised portion of the three-dimensional surface on the adjacent structural insulated building unit when in mating engagement with the adjacent structural insulated building unit.

In a further aspect of the embodiment, the structural insulated building unit can accommodate at least one of an adhesive, a seal, and a gasket on at least a portion of the three-dimensional surface when in mating engagement with the adjacent structural insulated building unit. In some aspects of the embodiment, the spline further includes opposing longitudinal sides, the longitudinal sides each including an alignment feature configured to align the first and second cementitious panels with the insulating core and the spline. The alignment feature can be a flange. The spline can include a cam chase to allow a cam to extend between the structural insulated building unit and the adjacent structural insulated building unit. The spline can further include an access hole through which the cam can be actuated for engaging or disengaging with one of the structural insulated building unit and the adjacent structural insulated building unit.

In some aspects of the embodiment, at least one of the first or second cementitious panels can have a pre-finished surface that faces outward from the structural insulated building unit. The pre-finished surface requires no additional finishing or modification after connecting the structural insulated building unit with adjacent structural insulated building units to erect the building or structure. The pre-finished surfaces can include at least one of a cementitious material, a ceramic, a concrete, a siding, or a wood, and at least one of the first or second cementitious panels can include one or more layers. The first or second cementitious panels can include a fiber-reinforced concrete layer.

In some aspects of the embodiment, the structural insulated building unit can be aligned and joined with the adjacent structural insulated building unit without screws or nails. The structural insulated building unit can further include a cam with a hook. The cam can hold, via the hook, the connecting portion in mating engagement with the complementary connecting portion at least while an adhesive sets. The structural insulated building unit and the adjacent structural insulated building unit can include an integrated alignment system whereby the structural insulated building unit and the adjacent structural insulated building unit can be aligned without additional alignment components. The structural insulated building unit can also include an access hole through which a cam can be actuated for engaging or disengaging with a hook receiving portion of an adjacent structural insulated building unit.

The structural insulated building unit can form an air- and water-tight structure or building, according to an aspect of the embodiment. The structural insulated building unit can form the air- and water-tight structure or building without sealing the structural insulated building unit in plastic wrap. The structural insulated building unit itself can be air- and water-tight. In an aspect of the embodiment, the structural insulated building unit can further include connecting portions on the other sides of the insulating core, where the connecting portions are splines. The splines and the first and second cementitious panels can create an air- and water-tight box around the insulating core.

In some aspects of the embodiment, splines extend along the sides of the insulating core for a total of four splines on four side of the insulating core, where at least one of the four splines is the connecting portion. When components of the structural insulated building unit are assembled, the structural insulated building unit can have a location precision between the components of at least one of: plus or minus one tenth of 1 mm, plus or minus one half of 1 mm, and plus or minus 1 mm. Referring to this location precision, the components can include the insulating core, the first and second cementitious panels, and the connecting portion. The splines can have a location precision of one-tenth of 1 mm with respect to each other. In some aspects of the embodiment, at least two of the splines that are on adjacent sides of the structural insulated building unit can include alignment holes on mating surfaces of the two splines, where the alignment holes are sized and shaped to receive a dowel or pin that spans from one of the two splines to the other of the two splines to align the two splines. The structural insulated building unit can further include a dowel or pin configured to be inserted into the alignment holes.

Another embodiment of the present invention includes a building or structure comprising a plurality of structural insulated building units according to the above-described embodiment. In the building or structure of this embodiment, the insulating core can include a foam insulating layer and foamed concrete. The connecting portion can align the structural insulated building unit with the adjacent structural insulated building unit with precision such that the first and second cementitious panels of the structural insulated building unit and the adjacent structural insulated building unit form continuous planar surfaces across edges of adjacent first and second cementitious panels. The connecting portion can align the structural insulated building units without additional alignment tools.

According to another embodiment of the present invention, a building or structure including a plurality of structural insulated building units is provided, where at least some of the structural insulated building units are connected using the connecting portion of the above-discussed embodiments.

According to an embodiment of the present invention, a structural insulated building unit system is provided that can enable constructing a building or structure in a single step of joining structural insulated building units to one another. In an aspect of the embodiment, the structural insulated building units include an insulating core and first and second cementitious panels. The insulating core is defined by a plurality of sides and opposing first and second faces of the insulating core. The first and second cementitious panels are coupled to the first and second faces of the insulating core. The structural insulated building units can further include connecting portions to align adjacent structural insulated building units having complementary connecting portions. In some aspects of the embodiment, the first and second cementitious panels have a pre-finished surface that faces outward from the structural insulated building unit. The pre-finished surface can be configured to require no additional finishing or modification after joining the structural insulated building units.

In aspects of the embodiment, the single step of joining the structural insulated building units includes aligning and connecting the structural insulated building units without the structural insulated building units being attached to a separate structural frame. The single step of joining the structural insulated building units can further include applying adhesive to one or more connecting portions of adjacent structural insulated building units. In addition, the single step of joining the structural insulated building units can include aligning and connecting the structural insulated building units without using screws or nails. The structural insulated building units can be configured to achieve, when joined, location precision of equal or less than one of: plus or minus 0.5 millimeters, plus or minus 1 millimeter, plus or minus 3 millimeters, and plus or minus 6 millimeters across a 2 meter span. The structural insulated building units can achieve precision without skilled labor in the constructing of the building or structure. At least some of the structural insulated building units can incorporate utility components such that connecting utilities of the building or structure is integrated into the single step of joining the structural insulated building units. The utility components can include electrical system components, plumbing system components, and/or sanitation system components.

An embodiment of the present invention provides an improved structural insulated panel for constructing a building or structure. The improved structural insulated panel includes an insulating core defined by a plurality of sides and opposing first and second faces of the insulating core, and first and second cementitious panels coupled to the first and second faces of the insulating core. The first and second cementitious panels can include fiber-reinforced concrete. In an aspect of the embodiment, the insulating core can include fiber-reinforced foamed concrete, expanded polystyrene foam, or both. In some aspects of the embodiment, the insulating core can include three layers that include an insulating layer as a central layer, and first and second foamed concrete layers on opposite faces of the insulating layer, where the insulating layer can include polystyrene foam, and the first and second foamed concrete layers can include fiber-reinforced foamed concrete. The insulating layer can be affixed to the first and second foamed concrete layer via an adhesive.

Another embodiment of the present invention is a foamed concrete material for use in construction of buildings or structures. The foamed concrete material can include a cement mixture, and a foaming agent. The cement mixture is fiber-reinforced, and the foamed concrete material is arranged as a porous foam structure having a fiber-reinforced matrix of the cement mixture with pores of air dispersed throughout the fiber-reinforced matrix. In aspects of the embodiment, the foamed concrete material is about 60% to 75% air by volume. In a further aspect, the foamed concrete material is about 75% air by volume. The foaming agent can be a polymer-based foaming agent or a surfactant-based foaming agent. The cement mixture can include: from about 25 to 40 percent by mass of cement; from about 10 to 20 percent by mass of fly ash; from about 1 to 5 percent by mass of polyvinyl alcohol fiber; from about 10 to 20 percent by mass of fire clay; from about 10 to 20 percent by mass of gypsum; and from about 10 to 20 percent by mass of acrylic binder. In some aspects, the cement mixture can further include from about 1 to 5 percent by mass of silica. In another aspect, the cement mixture further includes from about 0 to 5 percent by mass of acrylic fiber. The cement mixture can further include water.

In aspects of the embodiment, the cement mixture includes glass fibers for fiber-reinforcement. The cement mixture can include fibers greater than 10 μm in diameter. The fibers can be about 30 μm in diameter, and can be about 6 to 12 mm in length. The cement mixture can include fibers for fiber-reinforcement, the fibers being about 10 to 20 percent of the cement mixture by volume.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

FIG. 35 shows a front view of the spline of FIG. 34, according to an embodiment of the present invention.

FIG. 36 shows a top view of the spline of FIG. 34, according to an embodiment of the present invention.

FIG. 37 shows a bottom view of the spline of FIG. 34, according to an embodiment of the present invention.

FIG. 38 shows a side view of the spline of FIG. 34, according to an embodiment of the present invention.

FIG. 39 shows a close-up front view of an end of the spline of FIG. 34, according to an embodiment of the present invention.

DETAILED DESCRIPTION OF THE INVENTION

Figure 1:
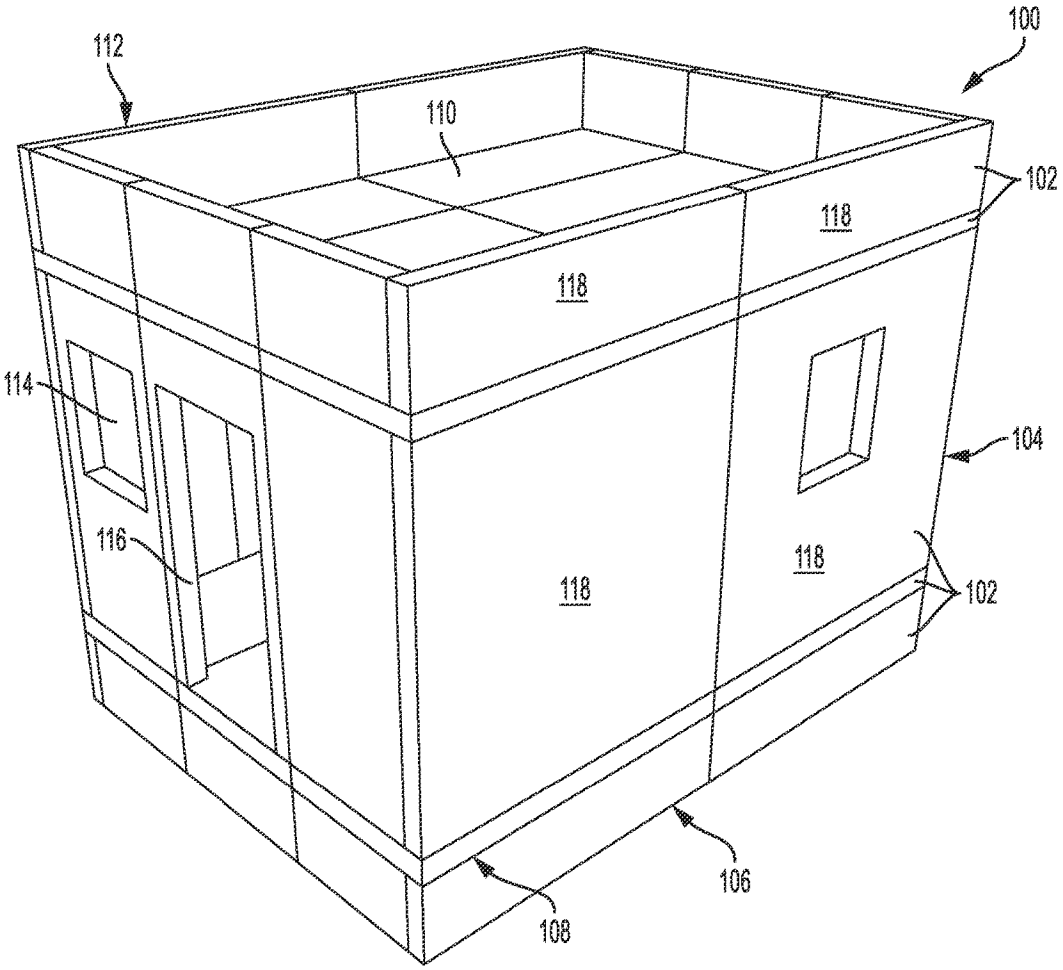
FIG. 1 shows a perspective view of a building constructed of structural insulated building units, according to an embodiment of the present invention.

Embodiments of the present invention include structural building components, materials, and methods that will revolutionize the building industry by simplifying and accelerating the construction process, while reducing cost and time of construction, decreasing or eliminating the need for skilled labor, and increasing efficiency in the construction process and the resulting buildings. Some embodiments of the present invention include prefabricated building components referred to herein as structural insulated building units (SIBUs). Each SIBU is a discrete component or building block that, when combined with additional SIBUs, can form a building or structure. SIBUs are designed to be put together in specified arrangements to result in a planned design. However, the SIBUs are not only prefabricated structural components, but also an integrated solution for all sub-systems of a building. For example, the SIBUs can provide inherent structural support for a building, eliminating the need for a separate structural frame. SIBUs can also incorporate elements of the utilities systems, such as plumbing and electrical wiring and components. The electrical components can include 12V wiring systems, which may not require transformers, and local power generation through renewables such as solar, wind, or mechanical power generation resulting in efficient and environmentally friendly buildings. Further, SIBUs can be factory finished so that all desired finishes are provided on the SIBUs, and no separate finishes need to be installed on-site. In some embodiments, an entire building—with all finishes, utilities, and structural support—can be completed with nothing more than SIBUs. Moreover, a SIBU-based system can be assembled on-site without the need for skilled labor due to simple alignment and connection mechanisms integrated into SIBUs. Thus, the SIBUs of the present invention are an integrated solution to many challenges in traditional construction.

Furthermore, according to some embodiments of the invention, SIBUs also provide improved performance in terms of strength and other characteristics, as discussed herein. The improved performance exhibited by SIBUs and structures built using SIBUs include increased strength, stiffness, durability, and lifespan, for example. In some aspects, the SIBU and the resulting structures exhibit improved handling of moisture and air- and water-tight sealing.

In some embodiments, a SIBU can include two structural panels with an insulating core between the structural panels. The two structural panels may each have exposed surfaces that are prefinished according to the desired aesthetic and/or function of that panel within the building. In addition, the structural panels can be formed of a material having sufficient strength to provide structural support to the SIBU and the resulting building. The insulating core can also provide strength and load distribution, in addition to thermal and noise insulation. The structural panels may be made of a cementitious material, such as fiber-reinforced concrete, for example. The insulating core may comprise expanded polystyrene (EPS), or foamed concrete, or both. The foamed concrete of the insulating core can be fiber-reinforced foamed concrete. Additional details of these components and materials are discussed below.

One advantage of the fiber-reinforced foamed concrete in some embodiments is the improved tolerance to condensation inside the SIBU. Condensation often forms inside of SIPs, for example, due to temperature differences between sides of the SIP. Such condensation can have a destructive effect on the insulation used in SIPs, especially when the condensation is localized or pools in an area. Freezing and thawing cycles of the condensation can further damage buildings. However, according to embodiments of the invention, the foamed concrete of the insulating core provides avenues for the condensation to dissipate and prevent pooling. In some embodiments, passageways and ports can be provided to allow the moisture to drain from one SIBU to another SIBU, or to an exterior of the SIBUs through one-way valves or membranes, for example.

The SIBU can also include a joining mechanism on one or more sides of the SIBU. This joining mechanism may be referred to herein as a spline. In some embodiments, the spline is formed of fiber-reinforced concrete, including, for example, extruded fiber-reinforced concrete. As discussed below, the spline can have an integrated alignment and connection system for aligning and connecting corresponding splines together. In this way, the SIBUs can be aligned and connected with each other. According to embodiments of the invention, this alignment and connection system is designed to align the SIBUs within design tolerances such that no additional alignment tools or manual alignment is needed to align the SIBUs and the degree of alignment of SIBUs can be controlled with high precision. Thus, the SIBUs can be self-aligning and the resulting building has a pleasing appearance due to even, aligned surfaces, which reduces the need for skilled labor to construct a building and reduces the need to take additional steps to correct or hide imperfectly aligned surfaces—a common problem in some traditional building techniques, including traditional SIPs.

The precise alignment of the splines can be accomplished in three-dimensions. This three-dimensional alignment (or x-y-z alignment) can be achieved, according to some embodiments, by a three-dimensional surface on a face of the spline that mates with a corresponding spline. As used herein, "x-y-z alignment" refers to alignment in directions having component directions parallel to three orthogonal axes, such as the x-, y-, and z-axes. As discussed below, a three-dimensional surface can be used for aligning the spline in three directions. In addition, the splines provide structural integrity to the SIBUs and the resulting building, as discussed in further detail below.

Due to the self-aligning system, and the integration of all needed building systems into the SIBUs, the construction process can be reduced to a one-step process of joining the SIBUs. Once the SIBUs are joined, the utilities, insulation, structural support, and finishes for the building are all provided by the integration of all of those elements into the SIBUs. In some embodiments, this single step process of combining SIBUs is accomplished without the need for screws, nails, and/or fasteners, or supporting structure such as beams and posts. Thus, contrary to conventional building construction, including traditional SIPs and other prefabricated building materials, it is not necessary to build a structural frame and attach the SIBUs to the frame with nails or screws, for example. The single step of joining the SIBUs can include applying adhesive to one or more splines.

Further details and embodiments of the present invention can be appreciated from the following detailed description of the figures.

FIG. 1 shows a perspective view of a building 100 constructed of SIBUs 102, according to an embodiment. The SIBUs 102 can be designed to incorporate cutouts for structural features such as a door 116, windows 114, and other inlets/outlets, including those for plumbing, heating/ventilation/air conditioning, and electrical wiring. The entire structure of the building, including the base, flooring, ceiling, and walls can be constructed from the SIBUs. For example, in FIG. 1, SIBUs 102 are used to form a base or foundation 106, which supports a floor 108 also formed of SIBUs 102. Walls 104 are formed on top of the floor 108, followed by a ceiling 110 and, optionally, a parapet 112. The building 100 in FIG. 1 is shown as an example of the type of structure that can be built using SIBUs 102. However, embodiments of the invention are not limited to the building 100 or configuration of SIBUs 102 shown in FIG. 1. According to embodiments, SIBUs can be provided in various shapes and size and can be joined together in numerous configurations to form simple or complex structures. As discussed below, aspects of embodiments of the invention can provide systems, methods, and apparatuses for coupling multiple SIBUs with precise alignment such that outer surfaces of the SIBUs form a continuous surface 118.

"Continuous surface" is intended to mean an outer surface created from a combination of SIBUs that are aligned with a high degree of precision such that the outer surfaces create a sufficiently smooth and unbroken surface that is satisfactory as an exposed, finished surface of the completed structure. Accordingly, the continuous surface 118 can be formed of SIBUs that are prefinished to provide the desired appearance of the built structure. In this way, it is not necessary to add additional structures to the SIBUs or to use additional alignment tools to achieve a surface suitable for an exposed surface of the finished structure. In some embodiments, alignment of the SIBUs has a location precision of less than or equal to 0.25 inches per SIBU, or less than or equal to 0.25 inches per eight feet. In some embodiments, the structural insulated building unit is configured to achieve location precision when assembled of equal or less than one of: plus or minus 0.5 millimeters, plus or minus 1 millimeter, plus or minus 3 millimeters, and plus or minus 6 millimeters across a 2 meter span. "Location precision" is intended to mean deviation from an absolute design and/or accuracy to a design dimension.

Figure 2:
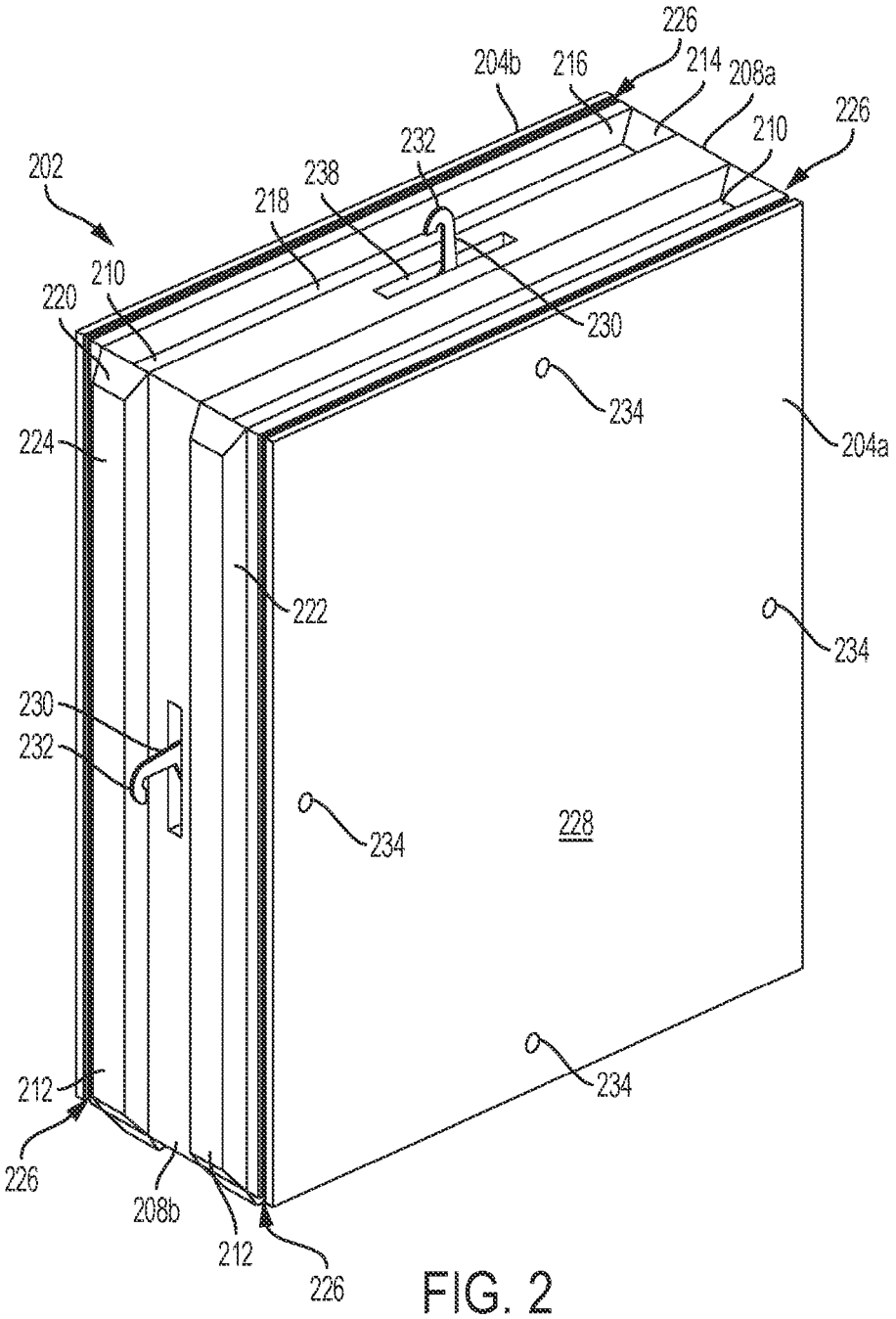
FIG. 2 shows a perspective view of an improved structural insulated building unit (SIBU), according to an embodiment of the present invention.

FIG. 2 shows a perspective view of a SIBU 202, according to an embodiment. The SIBU 202 includes a core (not shown in FIG. 2) that may include insulation and/or structural layers. First and second outer layers 204*a*, 204*b* are provided on either side of the core, and can correspond to interior and exterior surfaces of the finished building or structure. However, depending on the design of the structure and the location of a given SIBU within the structure, the first and second outer layers 204*a*, 204*b* may be interior surfaces, exterior surfaces, or some combination of interior and exterior surfaces. The first and second outer layers 204*a*, 204*b* can be prefinished such that no additional finishing is needed during or after erecting the structure. This "prefinishing" of the panels can done during manufacture or assembly of the SIBU, and can thus be performed off-site of the actual location of the building or structure. Splines 208*a*, 208*b* are disposed adjacent to the core of the SIBU 202 and between the first and second outer layers 204*a*, 204*b*. Additional splines may be located on other sides of the SIBU 202, but are not visible in FIG. 2. The splines 208*a*, 208*b* are used for aligning and coupling SIBU 202 to additional SIBUs placed adjacent to one of the splines of SIBU 202. These splines 208*a*, 208*b* can have a three-dimensional surface that engages with corresponding three-dimensional surfaces on other splines to provide precise alignment of the SIBUs relative to each other. According to embodiments, this precise alignment can be achieved in three-dimensions. As shown in FIG. 2, a spline 208*b* on the left side of the SIBU 202 has a three-dimensional surface that includes projections 212, which project outward from a center of the SIBU 202. According to the embodiment in FIG. 2, each projection has two end side walls 220, two longitudinal side walls 222, and a top surface 224. The end side walls 220 and the longitudinal side walls 222 are inclined with respect to a base surface of the spline 208*b*, according to some embodiments. Other splines, including spline 208*a* at the top side of the SIBU 202 in FIG. 2, includes recesses 210. The recesses 210 can substantially correspond to the shape and dimension of projections on a complementary spline of a neighboring SIBU so that neighboring SIBUs can fit together when projections are inserted into the corresponding recesses. For example, the spline 208*a* includes recesses 210 having two end side walls 214, two longitudinal side walls 216, and a bottom surface 218. The end side walls 214 and the longitudinal side walls 216 are inclined with respect to a base surface of the spline 208*a*. The splines 208*a*, 208*b* can further include a seal groove 226, which is a groove in the spline within which a sealing material can be placed. The sealing material maybe be a strip of rubber or other compliant material, for example. In some embodiments, the seals and precise alignment can enable a structure of coupled SIBUs that is air- and/or water-tight. The splines 208*a*, 208*b* and first and second outer layers 204*a*, 204*b* can be formed of fiber-reinforced concrete, and can provide structural integrity to the structure built with the SIBUs. The splines can be made of a number of materials, including wood, metal, StarStone® material, precast concrete, plastic, and other materials.

The SIBUs may also include additional attachment elements, in some embodiments. For example, as shown in FIG. 2, cams 230 can be built into the SIBU 202 and can extend through a cam chase 238 in the splines 208*a*, 208*b* so that the hook 232 of the cam 230 can engage with a hooking portion of another SIBU. The cam 230 can be activated via an access hole 234 formed in the side of the SIBU 202. For example, a small tool can be inserted into the access hole 234 and can cause the cam 230 to engage a hooking portion of another SIBU by rotating the cam 230 into an engagement position. This can help hold the SIBUs together when, for example, waiting for an adhesive between adjacent splines to dry.

At least one of the first and second outer layers 204*a*, 204*b* can have a prefinished surface 228. The prefinished surface 228 can be an interior and/or exterior surface of a building or structure so that no further finishes are required after the panels are coupled together.

Figure 3:
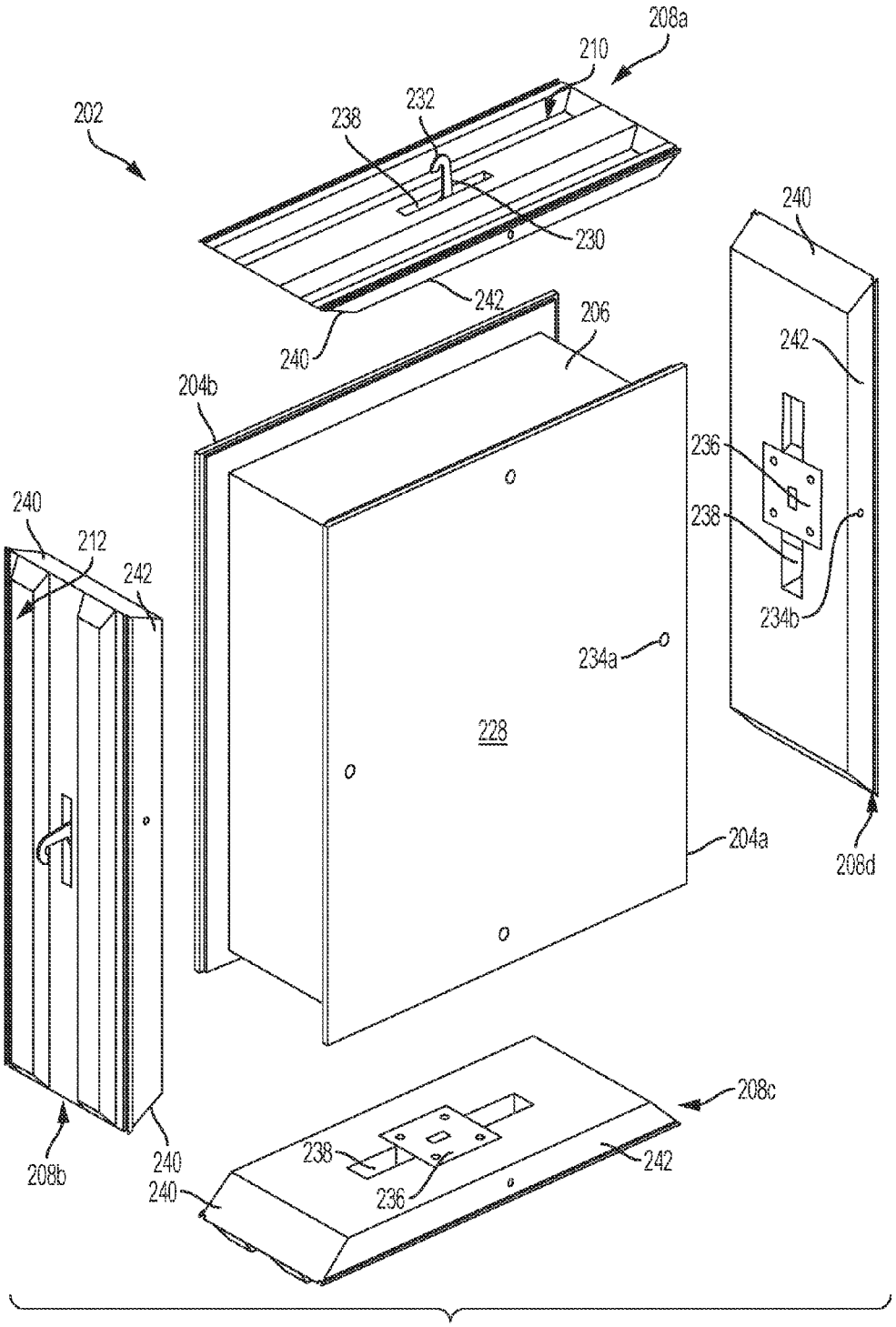
FIG. 3 shows an exploded perspective view of the SIBU of FIG. 2, according to an embodiment of the present invention.

FIG. 3 shows an exploded perspective view of SIBU 202, which reveals the core 206 and additional sides of splines 208*a*-208*d*. The core 206 can be formed of an insulating material, such as polystyrene, insulating foam, or any of various insulating materials that are well known in the art. In some embodiments, the core 206 is a composite or multi-layer structure, as discussed in detail further below. In addition to thermal insulation, the core 206 can provide structural support, as well as a number of other advantages including sound insulation, weather proofing, and improved handling of moisture within the structure. In some embodiments, the insulating core has sufficient rigidity to transfer load between the structural first and second outer layers 204*a*, 204*b* so that they act as a single structure under load.

Cam plates 236 are visible on the back of splines 208*c* and 208*d*. The cam plates 236 secure the cams to the splines. Each of the splines 208*a*-208*d* include a pair of end side walls 240 and a pair of longitudinal side walls 242. In some embodiments, the end side walls 240 and longitudinal side walls 242 are angled or inclined, as shown in FIG. 3. The end side walls 240 can be angled so that the end side walls 240 of adjacent, perpendicular splines are flush when installed in the SIBU. The angle of the end side walls 240 can be specified to ensure proper alignment of the splines with one another, which impacts the alignment of coupled SIBUs in the building. Flush contact and alignment between adjacent SIBUs can also provide structural strength and stability to the SIBU and the structure built from a plurality of SIBUs. If the end side walls 240 of adjacent splines are not properly aligned, the structural integrity of the SIBU and building can be compromised. Thus, it is important to ensure precision in the alignment of mating end side walls 240 of adjacent splines. According to embodiments of the invention, the splines can be aligned with a location precision of 0.1 mm. In other embodiments, the location precision can be 0.2 mm, 0.3 mm, 0.4 mm, 0.5 mm, 0.6 mm, 0.7 mm, 0.8 mm, 0.9 mm, or 1 mm. In some embodiments, the splines can be designed with features to aid in this alignment. In an aspect of an embodiment, such features can include holes formed in adjacent splines, where the holes at least open on the end side walls 240 and align with each other when the adjacent splines are properly aligned. A dowel or pin can be inserted into or through the holes to ensure that the end side walls 240 do not shift relative to each other. Insertion of the dowel or pin can be performed around the time of applying adhesive to the SIBUs. The number of dowels or pins used can be from zero to four per end side wall of a spline. According to various embodiments, the splines can be formed from fiber-reinforced concrete, which provides advantageous structural properties, including strength and toughness, to the splines. The inclined longitudinal side walls 242 can help in aligning the splines 208*a*-208*d* next to the core 206 and between the first and second outer layers 204*a*, 204*b*. Additional aspects of this alignment will be discussed below.

Figure 4:
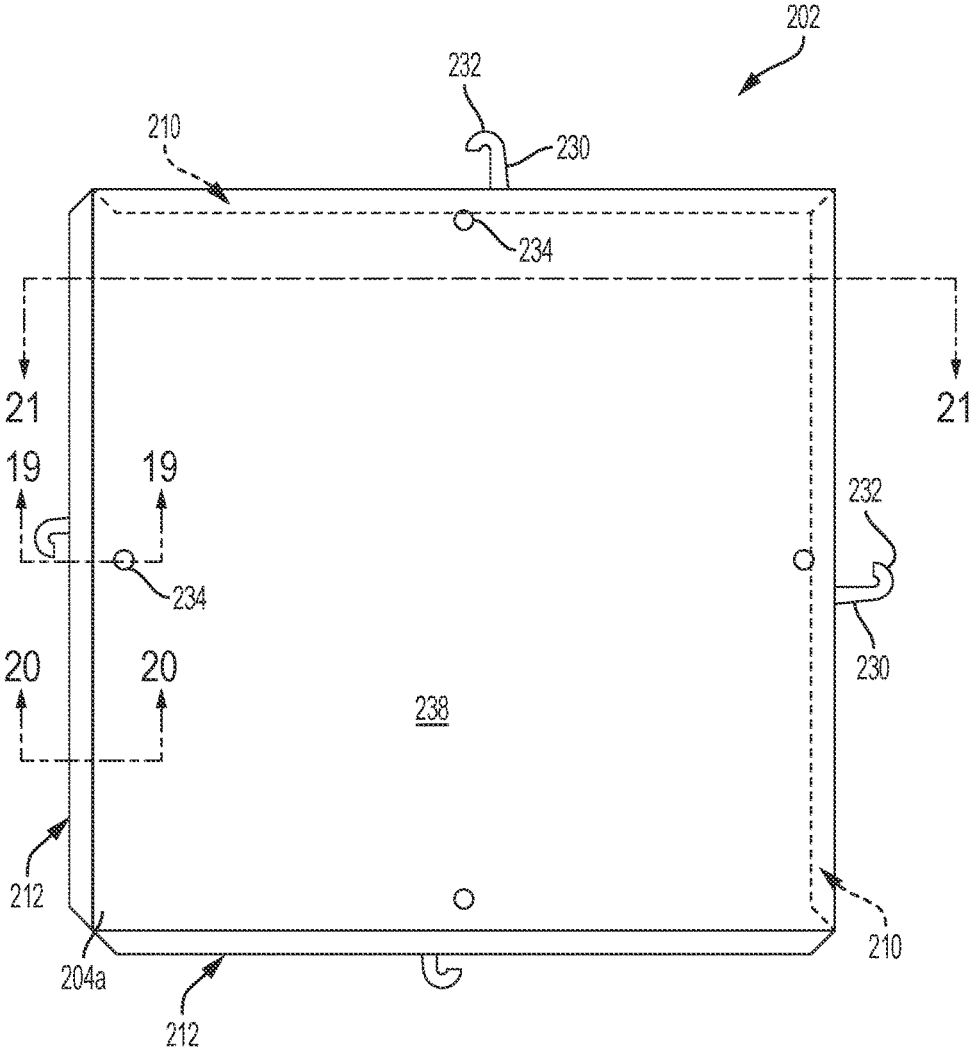
FIG. 4 shows a front view of the SIBU of FIG. 2, according to an embodiment of the present invention.

FIG. 4 shows a front view of the SIBU 202 of FIG. 2, according to an embodiment of the present invention. The dashed lines on the top and right sides of the SIBU are used to show the locations of recesses 210 on those sides of the SIBU 202, while projections 212 are located on the left and bottom sides of the SIBU 202. However, embodiments are not limited to SIBUs having only this configuration of three-dimensional spline surfaces. In some embodiments, it may be preferred to arrange the SIBUs such that the top edge of a SIBU has a spline with a recess 210. In this way, it may be easier to position another SIBU with a projection 212 on the bottom edge on top of a lower SIBU by lowering the projection 212 into the recess 210. A cam 230 with a cam hook 232 is shown extending outward from each side of the SIBU 202 in FIG. 4. However, embodiments are not limited to this a configuration of cams. For example, cams may be provided on only some of the side edges of the SIBU, or on none of the sides, according to some embodiments. Access holes 234 are located near each cam 230. A person building a structure using the SIBUs can insert a smaller tool through the access hole 234 to activate the cam 230 and cause the cam hook 232 to engage a cam hooking portion of an adjacent SIBU. In addition, while inserted at least partially into the access hole 234, the tool can be used as a handle by the person for lifting or moving the SIBU, and for sliding the SIBU into engagement with another SIBU of the building or structure.

Figure 5:
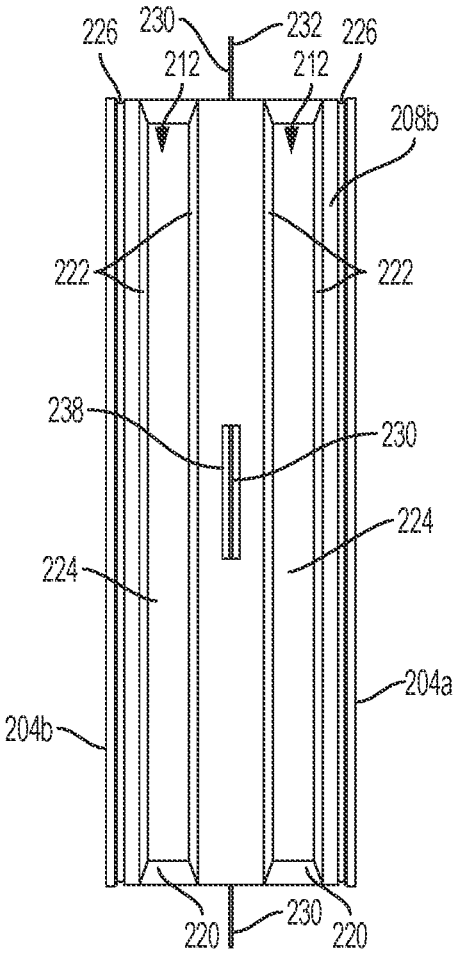
FIG. 5 shows a left side view of the structural insulated building unit of FIG. 2, according to an embodiment of the present invention.

FIG. 5 shows a left side view of the SIBU of FIG. 2, including the spline 208*b* with three-dimensional projections 212. The inclination of the end side walls 220 and longitudinal side walls 222 can be seen in FIG. 5, and results in a truncated, rectangular pyramid shape of the projections 212. The cam 230 of spline 208*b* is between the projections 212 and extending from the cam chase 238. To the outside of the projections are the seal grooves 226. In some embodiments, a seal can be pre-installed into a seal groove 226 for easier assembly. However, a seal can also be placed into the seal groove 226 at the time of constructing the building made of a plurality of SIBUs.

Figure 6:
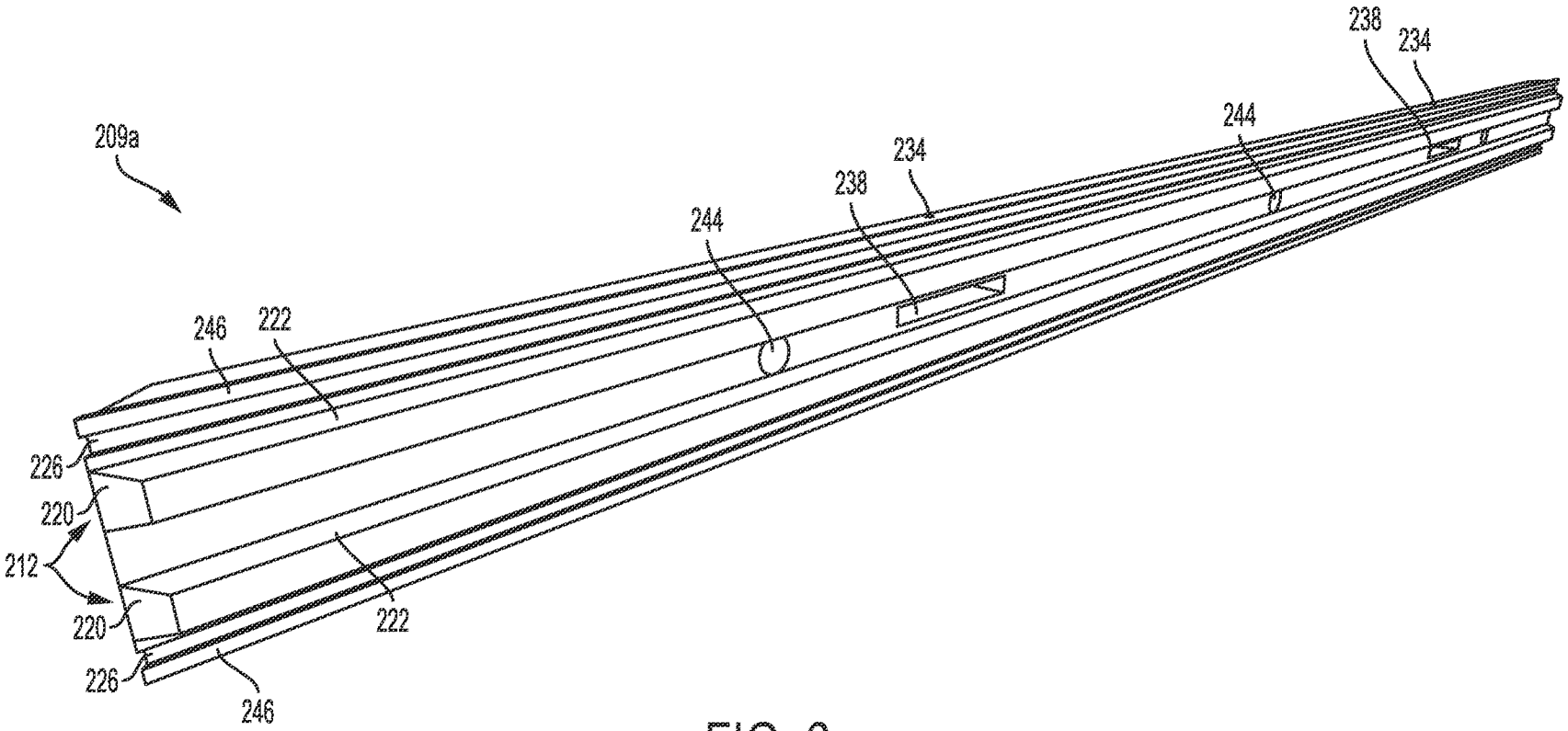
FIG. 6 shows a perspective view of a spline having projections, according to an embodiment of the present invention.

Splines can be formed in various sizes. In some embodiments, the spline is formed of extruded concrete or extruded fiber-reinforced concrete. The splines can be extruded in long sections and that cut to a desired size. The splines can also be formed by pouring fiber-reinforced concrete into forms. FIG. 6 shows a perspective view of an example of a spline 209*a* having projections 212 and multiple cam chases 238. The seal grooves 226 can accommodate a seal to help make the resulting structure air- and/or water-tight. A corresponding spline that would engage the spline in FIG. 6 can also include such a seal groove so that that the two grooves together surround the seal. The spline 209*a* also includes a flange 246 to the outside of each seal groove 226. As discussed below, the flange 246 can be used to align first and second outer layers to the sides of a SIBU to which spline 209*a* is attached. Electrical chases 244 can also be formed in the spline 209*a*, according to some embodiments. Electrical wire, cabling, or other utilities or conduits can be passed through the electrical chase 244. Similarly, electrical chases can be formed in other portions of the SIBUs to allow wire and cabling to run throughout the building constructed from SIBUs.

Figure 7:
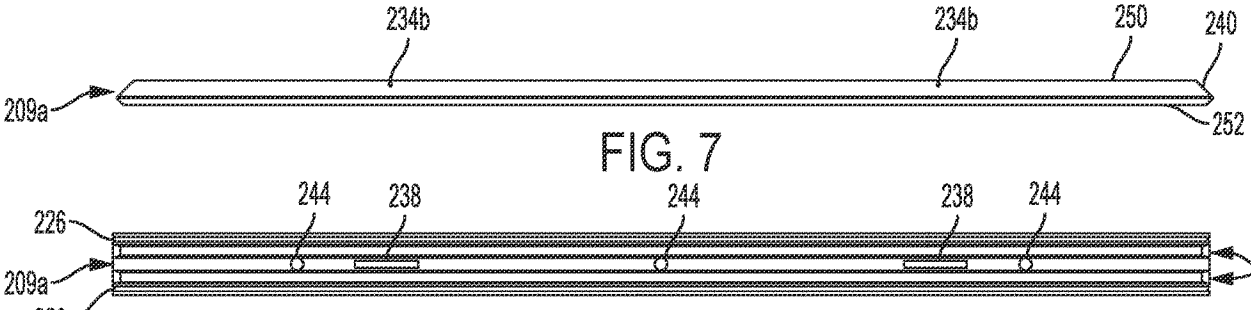
FIG. 7 shows a front view of the spline of FIG. 6, according to an embodiment of the present invention.
Figure 8:
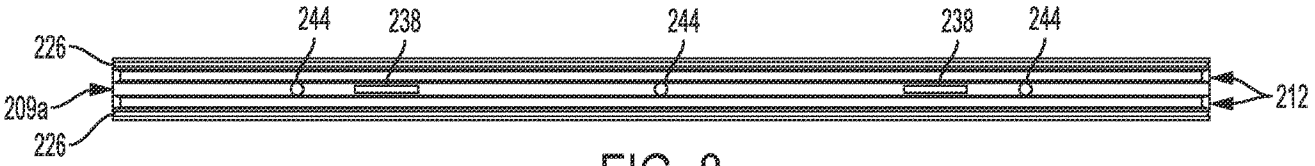
FIG. 8 shows a plan view of the spline of FIG. 6, according to an embodiment of the present invention.
Figure 9:
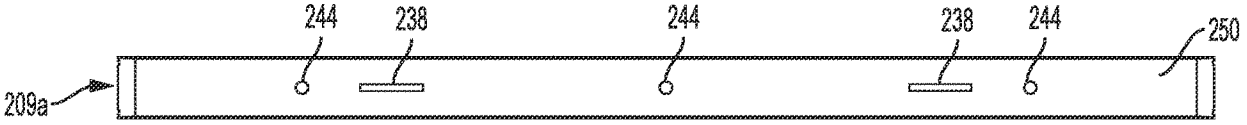
FIG. 9 shows a bottom view of the spline of FIG. 6, according to an embodiment of the present invention.
Figure 11:
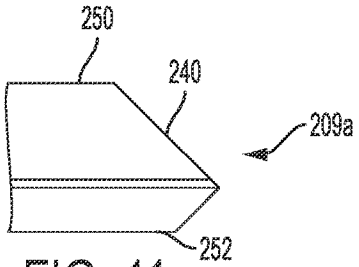
FIG. 11 shows a close-up front view of an end of the spline of FIG. 6, according to an embodiment of the present invention.
Figure 10:
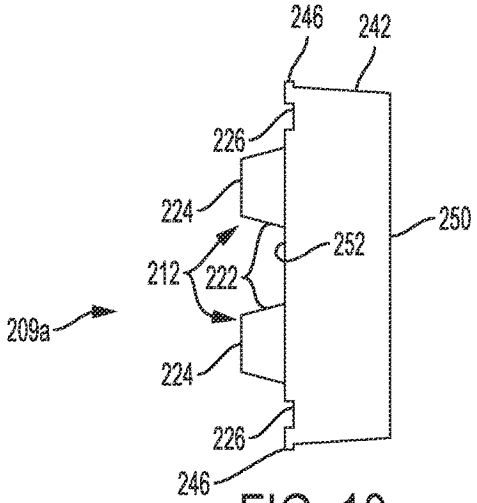
FIG. 10 shows a side view of the spline of FIG. 6, according to an embodiment of the present invention.

FIGS. 7-11 show alternative views of the spline of FIG. 5. Specifically, FIG. 7 shows a front view, FIG. 8 shows a plan view, FIG. 9 shows a bottom view, FIG. 10 shows a side view, and FIG. 11 shows a close-up front view, according to an embodiment of the present invention. Access holes 234*b* in FIG. 7 are provided so that a user can access and actuate the cam, which would be located proximate to the access hole 234*b* and cam chase 238. FIG. 10 shows the projections 212 for connecting with other SIBUs, the seal grooves 226, and the flanges 246. The first and second outer layers to be placed on opposite sides of the spline 209*a* can have an alignment feature in their back surface that allows the first and second outer layers to be aligned with the spline 209*a*, and thereby aligned with the SIBU and with adjacent SIBUs and outer layers. Thus, the first and/or second outer layers on a plurality of SIBUs can each be aligned with adjacent first and/or second outer layers to form a continuous outer surface on a building constructed from a plurality of SIBUs. The spline 209*a* has a mounting side 250 for attaching the spline 209*a* to a core of a SIBU, and a coupling side 252 for coupling the spline 209*a* to a complimentary spline of another SIBU. In the content of splines, "complimentary" is intended to mean that the splines have surfaces that are intended to be coupled together. For example, a first spline may have a three-dimensional surface and a second spline may have a three-dimensional surface that is approximately an inverse of the three-dimensional surface of the first spline, at least with respect to certain three-dimensional features such as the projections and recesses discussed above and further below. In other words, the three-dimensional surfaces of complimentary splines fit together in a way that helps align and/or couple the splines together.

Figure 12:
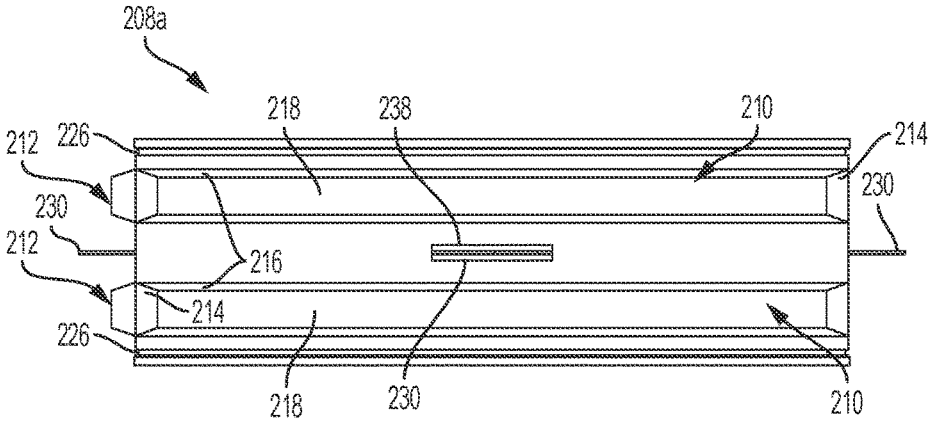
FIG. 12 shows a top side view of the SIBU of FIG. 2, according to an embodiment of the present invention.

FIG. 12 shows a top view of the SIBU 202 of FIG. 2, according to an embodiment. In FIG. 12, the three-dimensional surface of the spline 208*a* has recesses 210, rather than projections. Similar to spline 208*b*, seal grooves 226 are located near the outer edge of the spline 208*a*. Also, the inclination of the end side walls 214 and longitudinal side walls 216 results in an inverted, truncated, rectangular pyramid shape of the recesses 210, which complement the truncated, rectangular pyramid shape of the projections 212 discussed above with reference to FIG. 5.

Figure 13:
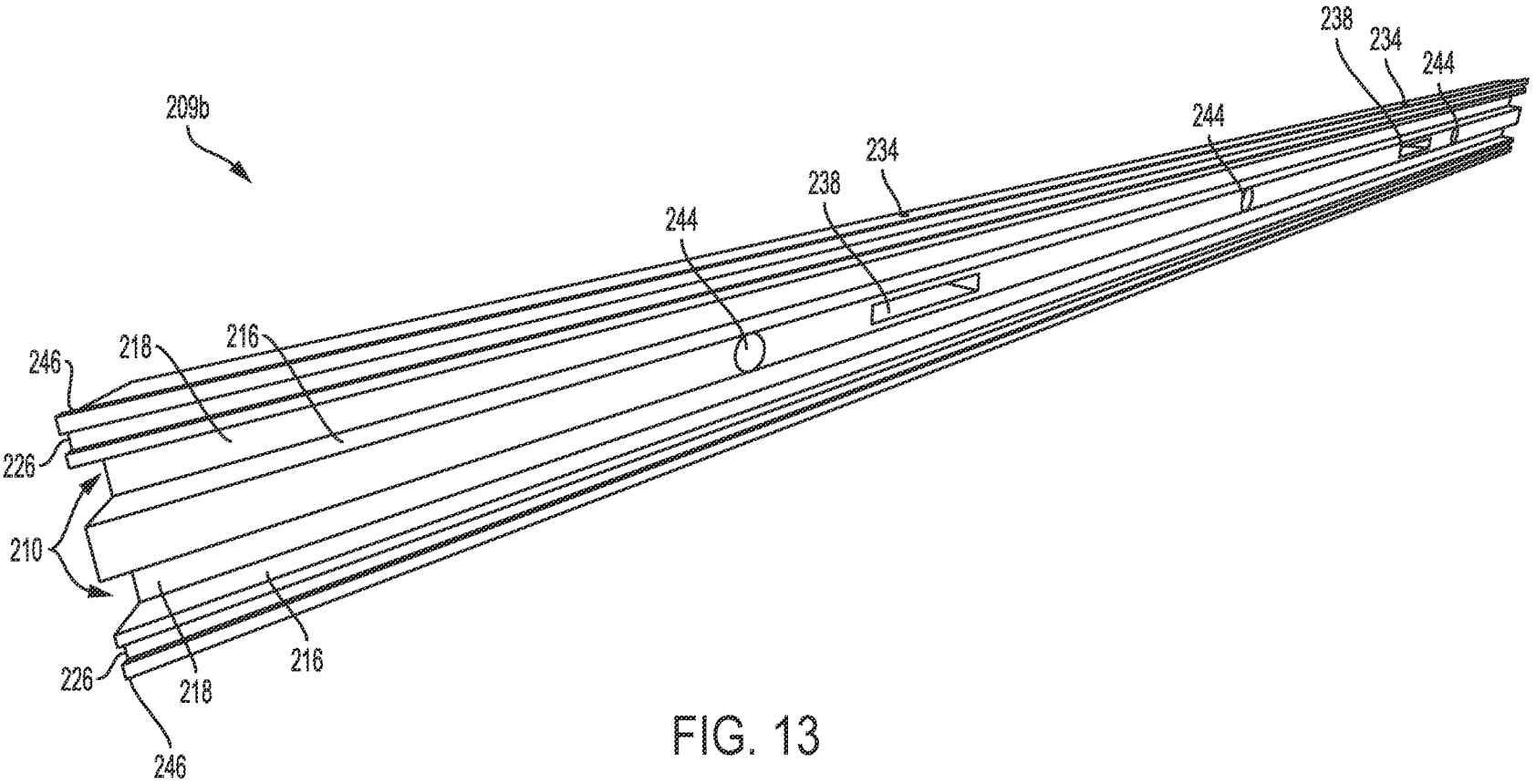
FIG. 13 shows a perspective view of a spline having recesses, according to an embodiment of the present invention.
Figure 14:
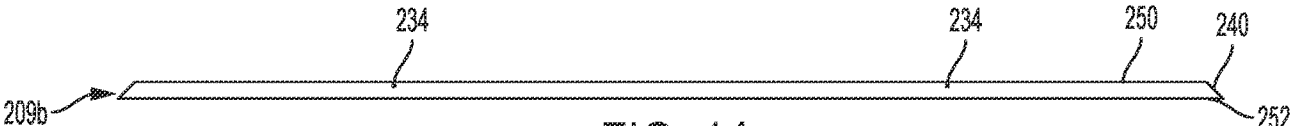
FIG. 14 shows a front view of the spline of FIG. 13, according to an embodiment of the present invention.
Figure 15:
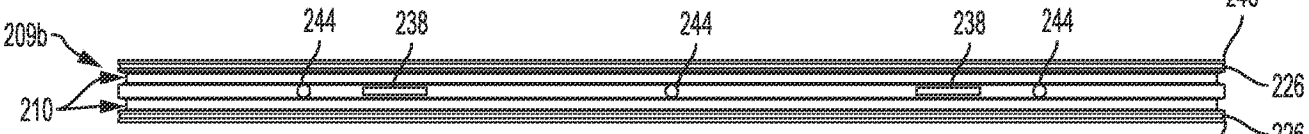
FIG. 15 shows a plan view of the spline of FIG. 13, according to an embodiment of the present invention.
Figure 16:
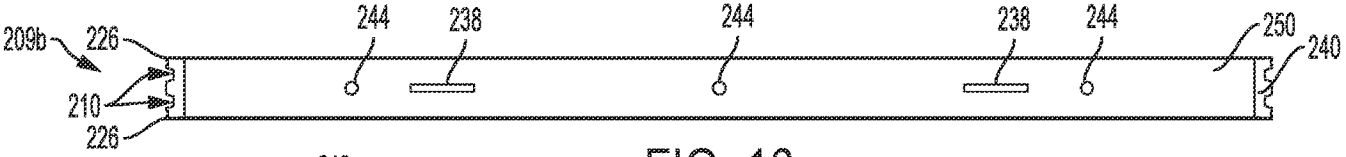
FIG. 16 shows a bottom view of the spline of FIG. 13, according to an embodiment of the present invention.
Figure 18:
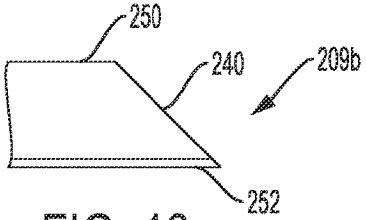
FIG. 18 shows a close-up front view of an end of the spline of FIG. 13, according to an embodiment of the present invention.
Figure 17:
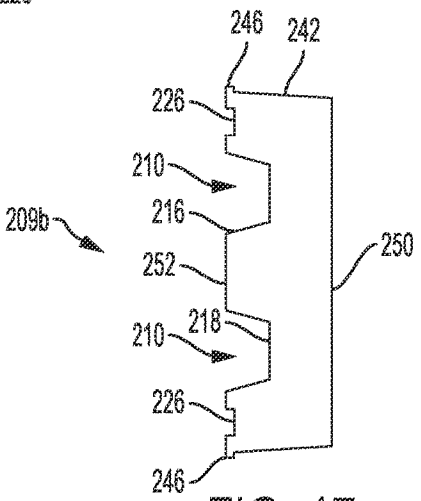
FIG. 17 shows a side view of the spline of FIG. 13, according to an embodiment of the present invention.

FIG. 13 shows a perspective view of a spline 209*b* having recesses 210, according to an embodiment of the present invention. FIGS. 14-18 show various views of the spline 209*b* of FIG. 13. Specifically, FIG. 14 shows a front view, FIG. 15 shows a plan view, FIG. 16 shows a bottom view, FIG. 17 shows a side view, and FIG. 18 shows a close-up front view of an end of the spline. The seal grooves 226 can accommodate a seal to help make the resulting structure air- and/or water-tight. A corresponding spline that would engage the spline in FIG. 13 can also include such a seal groove so that that the two grooves together surround the seal. The spline 209*b* also includes a flange 246 to the outside of each seal groove 226. As discussed below, the flange 246 can be used to align first and second outer layers to the sides of a SIBU to which spline 209*b* is attached. Electrical chases 244 can also be formed in the spline 209*b*, according to some embodiments. Electrical wire, cabling, or other utilities or conduits can be passed through the electrical chase 244. Similarly, electrical chases can be formed in other portions of the SIBUs to allow wire and cabling to run throughout the building constructed from SIBUs. Access holes 234 in FIG. 14 are provided so that a user can access and actuate the cam, which would be located proximate to the access hole 234 and cam chase 238.

Figure 19:
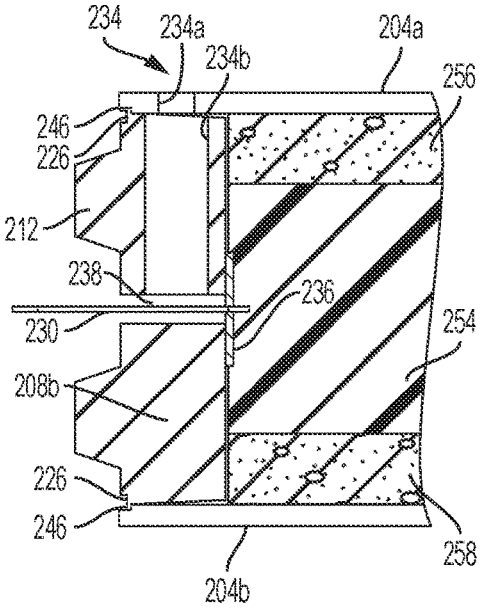
FIG. 19 shows a partial cross-section view of the SIBU of FIG. 4 along the line 19-19, according to an embodiment of the present invention.
Figure 20:
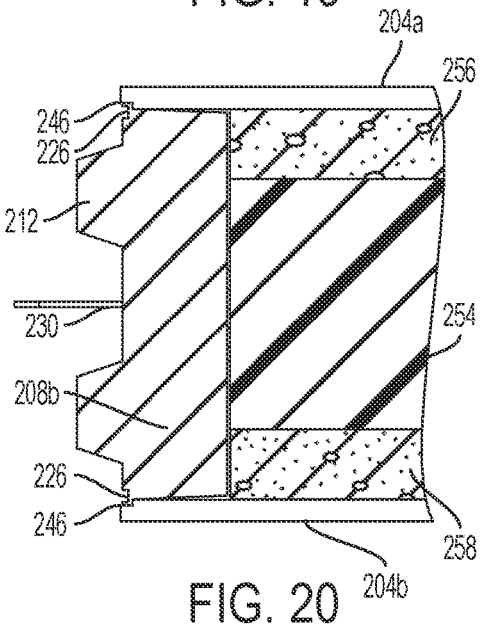
FIG. 20 shows a partial cross-section view of the SIBU of FIG. 4 along the line 20-20, according to an embodiment of the present invention.
Figure 21:
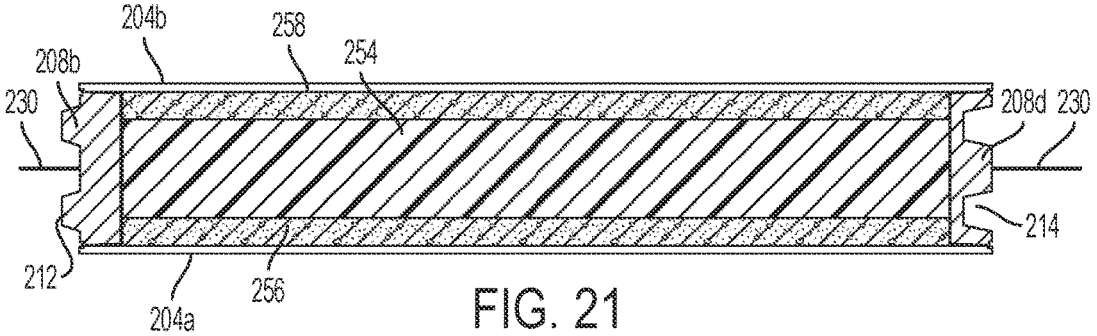
FIG. 21 shows a cross-section view of the SIBU of FIG. 4 along the line 21-21, according to an embodiment of the present invention.

FIG. 19 shows a partial cross-section view of the SIBU 202 of FIG. 4 along the line 19-19, according to an embodiment of the present invention. FIG. 19 shows the projections 212 of spline 208*b*, as well as the seal grooves 226 and flanges 246. Also, a cam 230 is shown extending through the cam chase 238, and an access hole 234 extends from an exterior of the SIBU at the first outer layer 204*a* to the cam 230. The access hole 234 includes an access hole 234*a* formed in the first outer layer 204*a*, and an access hole 234*b* formed in the spline 208*b*. Thus, cam 230 can be turned or actuated via a tool inserted through the access hole 234 so that adjacent SIBUs can be held together by the cam 230 for additional security. In some embodiments, the cam 230 holds the SIBUs securely together while waiting for an adhesive to dry between splines of the SIBUs. FIG. 20 shows a partial cross-section view of the SIBU 202 of FIG. 4 along the line 20-20 where a cam and access whole are not located. In the embodiments shown in FIGS. 19 and 20, a core of the SIBU has a three-layer structure. In some embodiments, these layers can correspond to a middle insulating layer 254, and outer layers 256, 258. For example, the middle insulating layer 254 can be polystyrene, an insulating foam or other insulation material. The layers 256, 258 can be outer structural layers. With outer structural layers 256, 258, the SIBU can provide increased structural strength over traditional polystyrene, for example. Outer structure layers 256, 258 can be a cementitious material. In some embodiments, the cementitious material of layers 256, 258 is foam concrete, or, in some preferred embodiments, fiber-reinforced foam concrete. By using the innovative fiber-reinforced foam concrete of the type described herein, as described in more detail elsewhere, the outer structural layers 256, 258 can provide various benefits including increased compressive tensile strength, thermal and noise insulation, smoke and burn resistance, bacterial and fungal resistance, and resistance to damage freeze/thaw damage, while being provided in a relatively light product by weight. For example, the fiber-reinforced foam concrete, according to embodiments of the inventions, can be 75% air. In other examples, the percentage of air can be less or more than 75%. Alternatively, the core can be just insulating material or foam, or just fiber-reinforced foam concrete, or another combination of insulating foam and fiber-reinforced foam concrete. Different layers of the core can be adhered together with an adhesive, such as a polyurethane adhesive. The core is not limited to these components and may include other materials, layers, or reinforcements. FIG. 21 shows a cross-section view of the SIBU 202 of FIG. 4 along the line 21-21.

Figure 22:
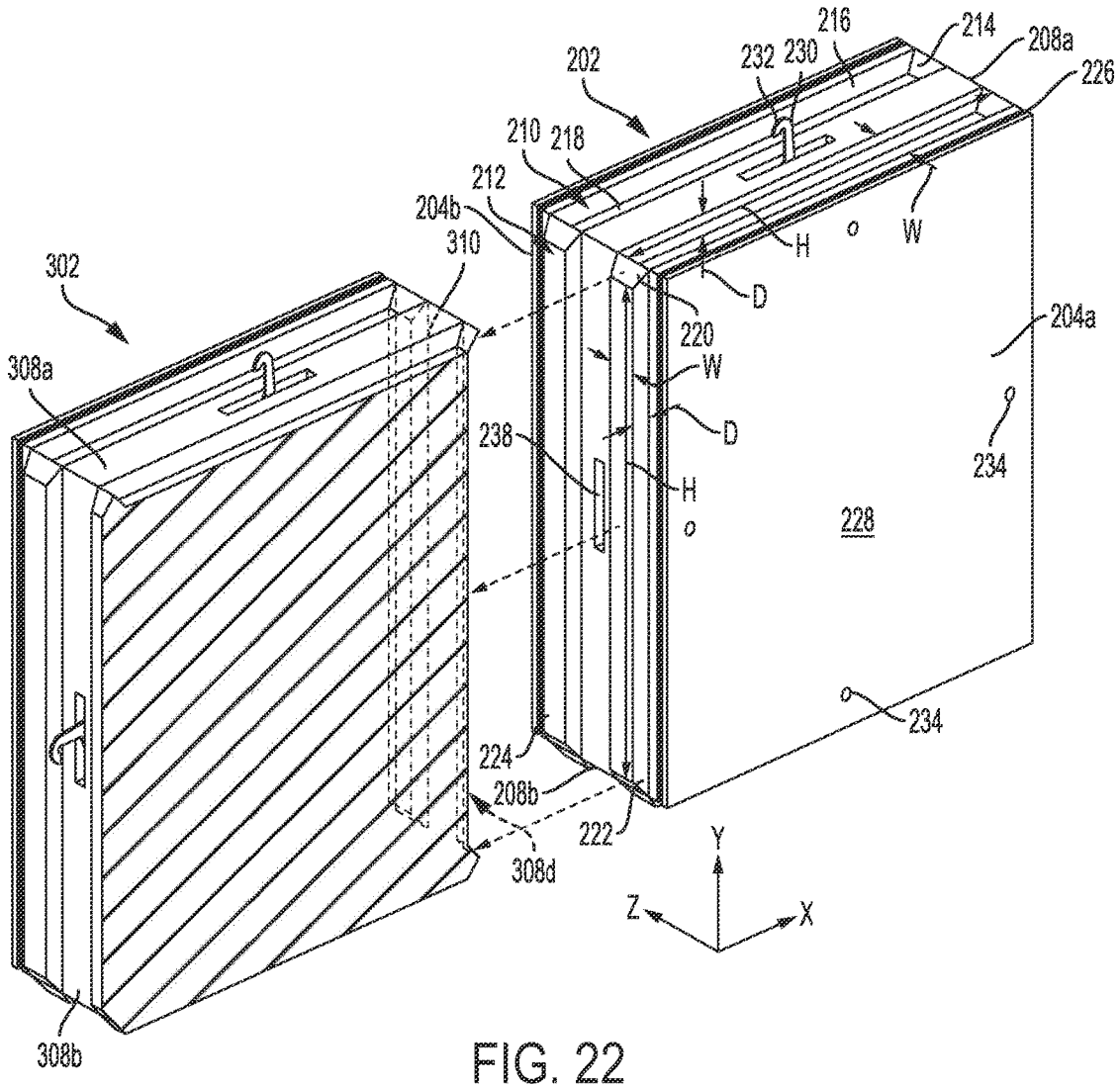
FIG. 22 shows the SIBU of FIG. 4 and another SIBU in a process of being joined, according to an embodiment of the present invention.
Figure 23:
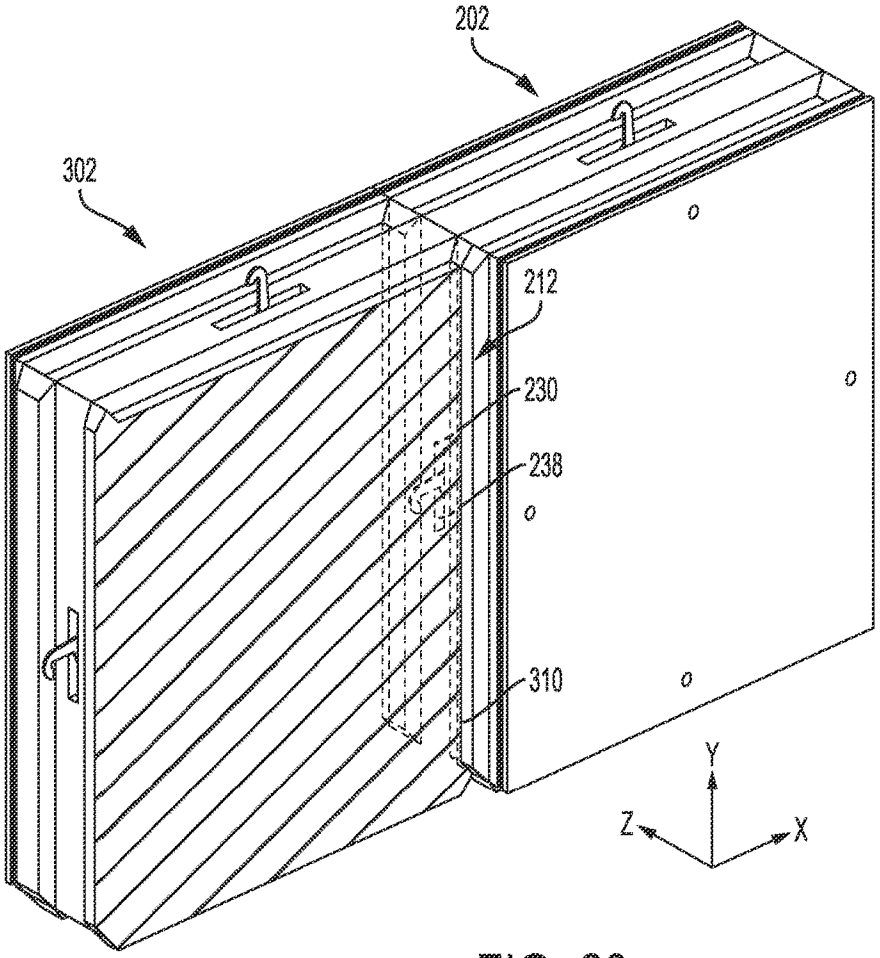
FIG. 23 shows the SIBUs of FIG. 22 after being joined, according to an embodiment of the present invention.

FIG. 22 shows a perspective view of SIBU 202 and a second SIBU 302 prior to the two SIBUs being aligned and coupled together. The second SIBU 302 is shown in a partial cross-section view to highlight the contour of the recess 310 of spline 308*d* that will be brought into mating engagement with the projection 212 of spline 208*b* on SIBU 202. A height H, width W, and depth D of the recess and projection of SIBU 202 is shown to indicate the three-dimensional nature of these features which helps to achieve the three-dimensional precision alignment of the SIBUs. Thus, the SIBUs can be securely and precisely aligned in three-dimensions corresponding to the x-, y-, and z-axes shown in FIG. 22. FIG. 23 shows a perspective view of the SIBUs 202, 302 of FIG. 22 after being connected. The cam 230 of spline 208*b* along the joined surfaces of the two SIBUs is shown extended in a locked position in FIG. 23. The partial cutaway view of the left SIBU in FIG. 21 shows the mating surfaces of the splines 208*b* and 308*d*.

Figure 24:
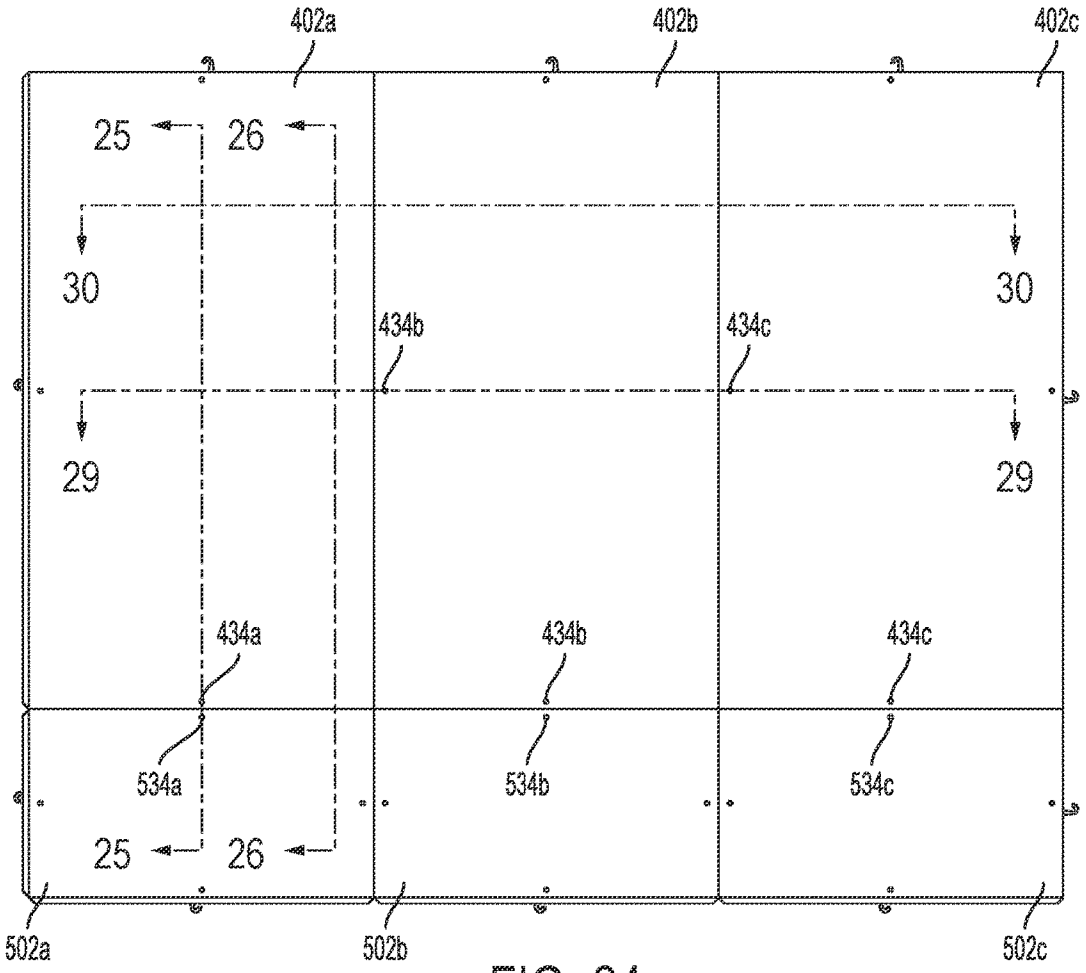
FIG. 24 shows a front view of a structure made from six SIBUs having different sizes, according to an embodiment of the present invention.

FIG. 24 shows a side view of a structure constructed from multiple connected SIBUs 402*a*-402*c* and 502*a*-502*c*, according to an embodiment. SIBUs 402*a*-402*c* are of a larger size than SIBUs 502*a*-502*c*. According to some embodiments, SIBUs of a same size or of various sizes can be combined in a single structure. Despite the size or number of SIBUs, however, they can be combined to form a structure with a finished appearance having good alignment and according to simple construction methods. Due to the precise alignment provided by SIBUs according to embodiments of the invention, the resulting surface created by the combination of multiple SIBUs, whether an interior or exterior surface of the SIBUs, can have a smooth appearance with joints that are easily aligned with tight tolerances. This result is not achieved in known systems or additional alignment tools, expertise and time of workers is required in existing systems to achieve good alignment. In addition, these interior and exteriors surface can be prefinished so that no additional finishing steps are required and the finished surface has a good appearance due to the precise alignment of the SIBUs.

The SIBUs in FIG. 24 are provided with access holes 434*a*-434*c* and 534*a*-534*c* for cams that join the SIBUs. In some embodiments, only one access hole needs to be located near the junction of two SIBUs to activate the one cam at that position of the junction.

Figure 25:
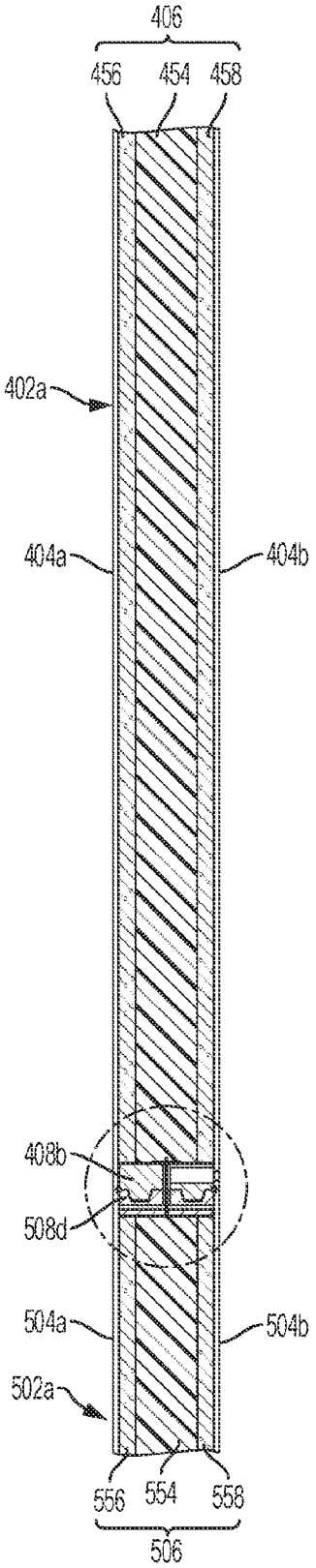
FIG. 25 shows a partial cross-section view of the structure of FIG. 24 along the line 25-25, according to an embodiment of the present invention.
Figure 26:
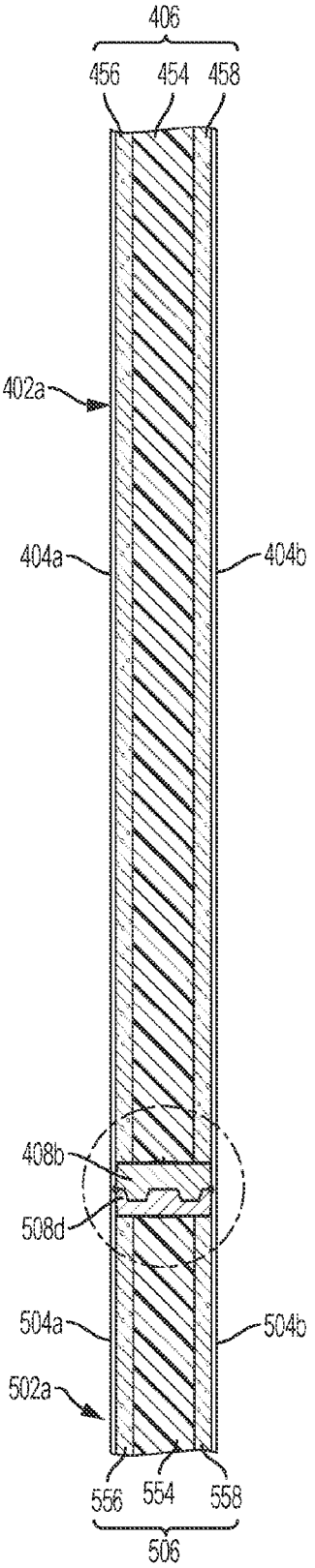
FIG. 26 shows a partial cross-section view of the structure of FIG. 24 along the line 26-26, according to an embodiment of the present invention.

FIG. 25 shows a cross-section view of the connected SIBUs of FIG. 24 along the line 25-25, which includes a junction of splines 408*b* and 508*d* where a cam is located. FIG. 26 shows a cross-section view of the connected SIBUs of FIG. 24 along the line 26-26 where there is no cam at the junction of splines 408*b* and 508*d*, according to an embodiment. SIBUs 402*a* and 502*a* each have multi-layer cores 406 and 506, respectively. In some embodiments, the cores 406 and 506 can have an identical structure including, for exampling, insulating cores 454 and 554, first foam concrete layers 456 and 556, and second foam concrete layers 458 and 558. However, in some embodiments, SIBUs in a structure can have differing structures, in terms of the first and second outer layers 404*a*, 404*b*, 504*a*, and 504*b*, and/or the core 406, 506 structure and materials. Such differences can occur between interior walls and walls that have a surface on an exterior part of the building, or between load-bearing and non-load-bearing walls, or where a different prefinished surface is desired between SIBUs.

Figure 27:
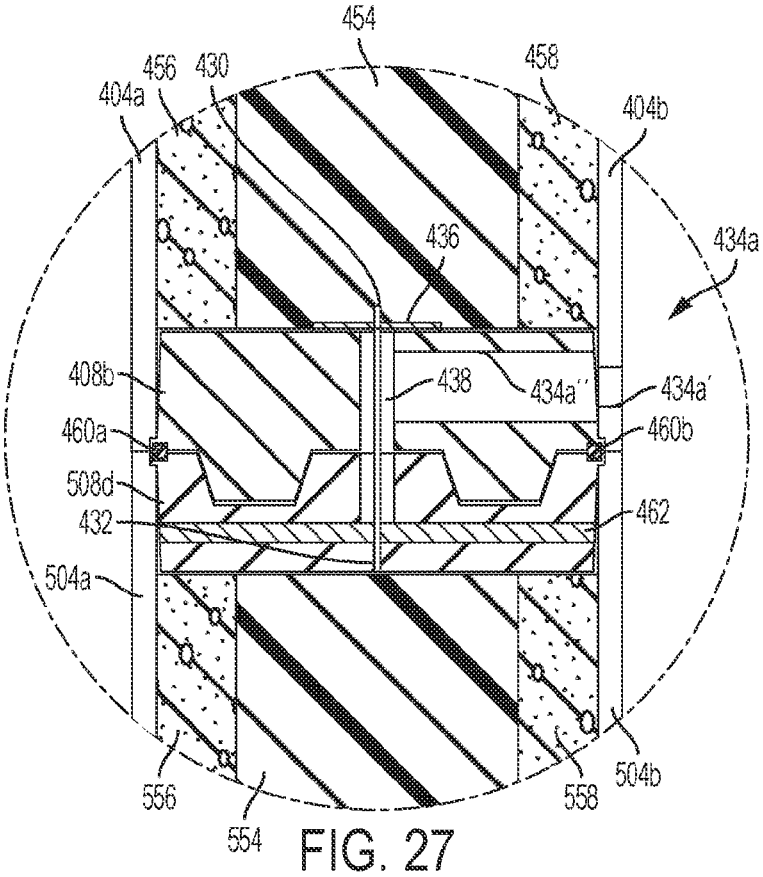
FIG. 27 shows a close-up view of a portion of the cross-section of FIG. 25, according to an embodiment of the present invention.
Figure 28:
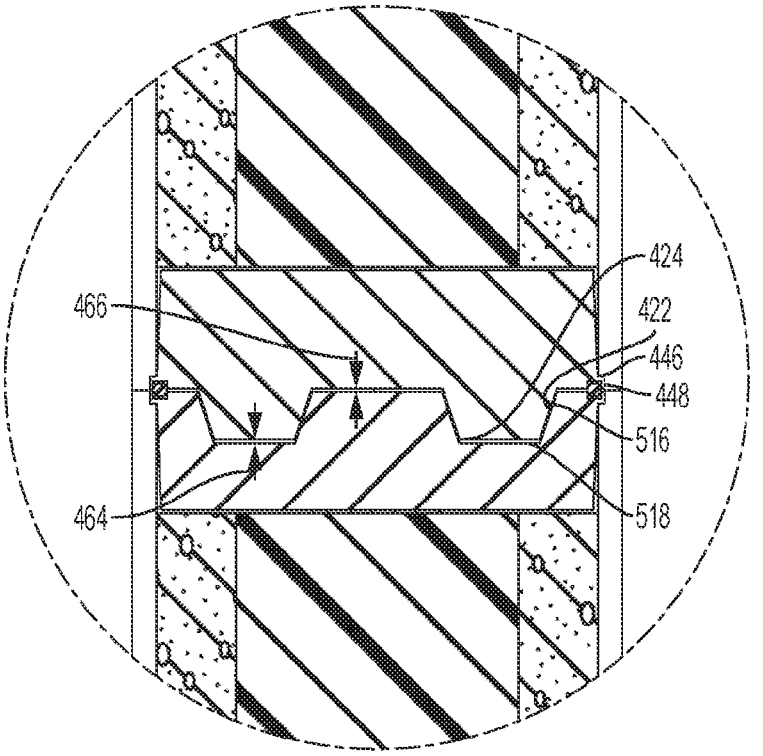
FIG. 28 shows a close-up view of a portion of the cross-section of FIG. 26, according to an embodiment of the present invention.

FIGS. 27 and 28 show close-up cross-section views of the circled portions in FIGS. 25 and 26, respectively. Seals 460*a* and 460*b* are shown in each of the seal grooves near the outer edges of the splines 408*b* and 508*d*. As discussed above, the seals 460*a* and 460*b* can be pre-attached to one or the other of the splines 408*b* and 508*d* during manufacturing or assembly of the SIBUs 402*a* and 502*a*. In this embodiment, the projections of spline 408*b* compliment the recesses of spline 508*d*. When the splines 408*b* and 508*d* are placed into mating engagement with each other, the complimentary projections and recesses engage each other so that the inclined surfaces 422 of the projections are in direct contact with the inclined surfaces 516 of the recesses. The splines are formed so that this direct contact causes the splines to be precisely aligned in multiple directions. This helps achieve tightly-sealed and structurally-sound arrangement of SIBUs. In addition, this helps the first and second outer layers 404*a*, 404*b* achieve precise alignments with first and second outer layers 504*a*, 504*b*, as well as other neighboring outer layers, so that a continuous, finished outer surface can be achieved. In some embodiments, a small gap 464 remains between the top 424 of the projection and the bottom 518 of the recess, as well as a gap 466 between the flat surfaces of the splines on either side of each projection/recess. Accordingly, spline 408*b* having projections can be easily inserted into the recesses of spline 508*d* while the inclined surfaces 422, 516 of the three-dimensional surfaces guide each spline into the desired alignment. The gap that remains can help ensure that the top 424 of the projection does not hit the bottom 518 of the recess before the desired alignment is reached, and can also provide space for placement of adhesive to help bond the splines 408*b*, 508*d*. Thus, the inclined contact surfaces of the splines, as well as the gap, can help achieve the precise alignment in three-dimensions.

FIG. 27 show a detailed cross-section at the location of a cam 430 in spline 408*b*. A cam 430 is anchored by the cam plate 436 on the back side of the spline 408*b*, and travels through cam chase 438 toward spline 508*d*. When the cam 430 is placed into a locking position as shown in FIG. 27, the cam hook 432 engages the hooking portion 462, which is a bar or some other secured or reinforced member within spline 508*d*. When in this locking position, the SIBUs can be held together by the cam 430. For example, the cam 430 can be used to hold the SIBUs together as an adhesive between splines 408*b* and 508*d* dries. The cam 430 can be actuated by a user inserting a tool through the access hole 434*a*, which includes an access hole 434*a*' in the second outer layer 404*b* and an access hole 434*a*" in the spline 408*b*. In some embodiments, the tool can be a specialized handheld tool that actuates the cam 430 by inserting the tool into the access hole 434*a* and then rotating the tool to put the cam into a locked or unlocked position. However, embodiments of the invention are not limited to this configuration, and various mechanisms for actuating the cam are possible. In some embodiments, the tool, while inserted at least partially into access hole 434*a*, can be used as a handle for lifting, moving, and positioning a SIBU.

Figure 29:
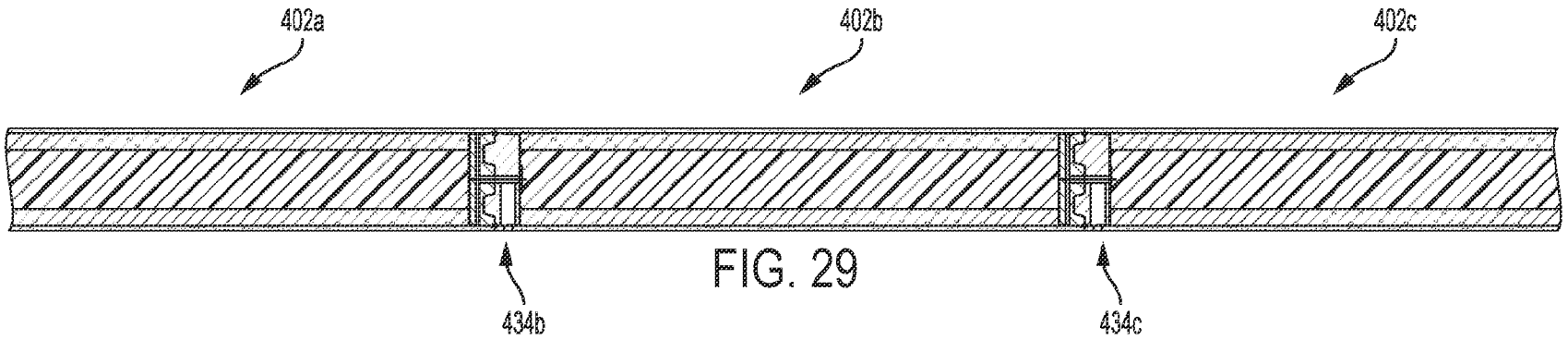
FIG. 29 shows a partial cross-section view of the structure of FIG. 24 along the line 29-29, according to an embodiment of the present invention.
Figure 30:
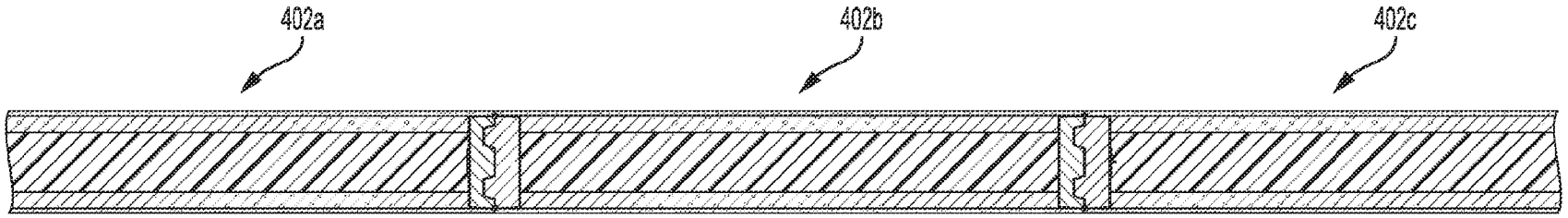
FIG. 30 shows a partial cross-section view of the structure of FIG. 24 along the line 30-30, according to an embodiment of the present invention.

FIG. 29 shows a cross-section view of the connected SIBUs of FIG. 24 along the line 29-29 through sections of splines that have a cam and cam hooking portion. FIG. 30 shows a cross-section view of the connected SIBUs of FIG. 24 along the line 30-30 through sections of the splines without cams, according to an embodiment of the present invention.

Figure 31:
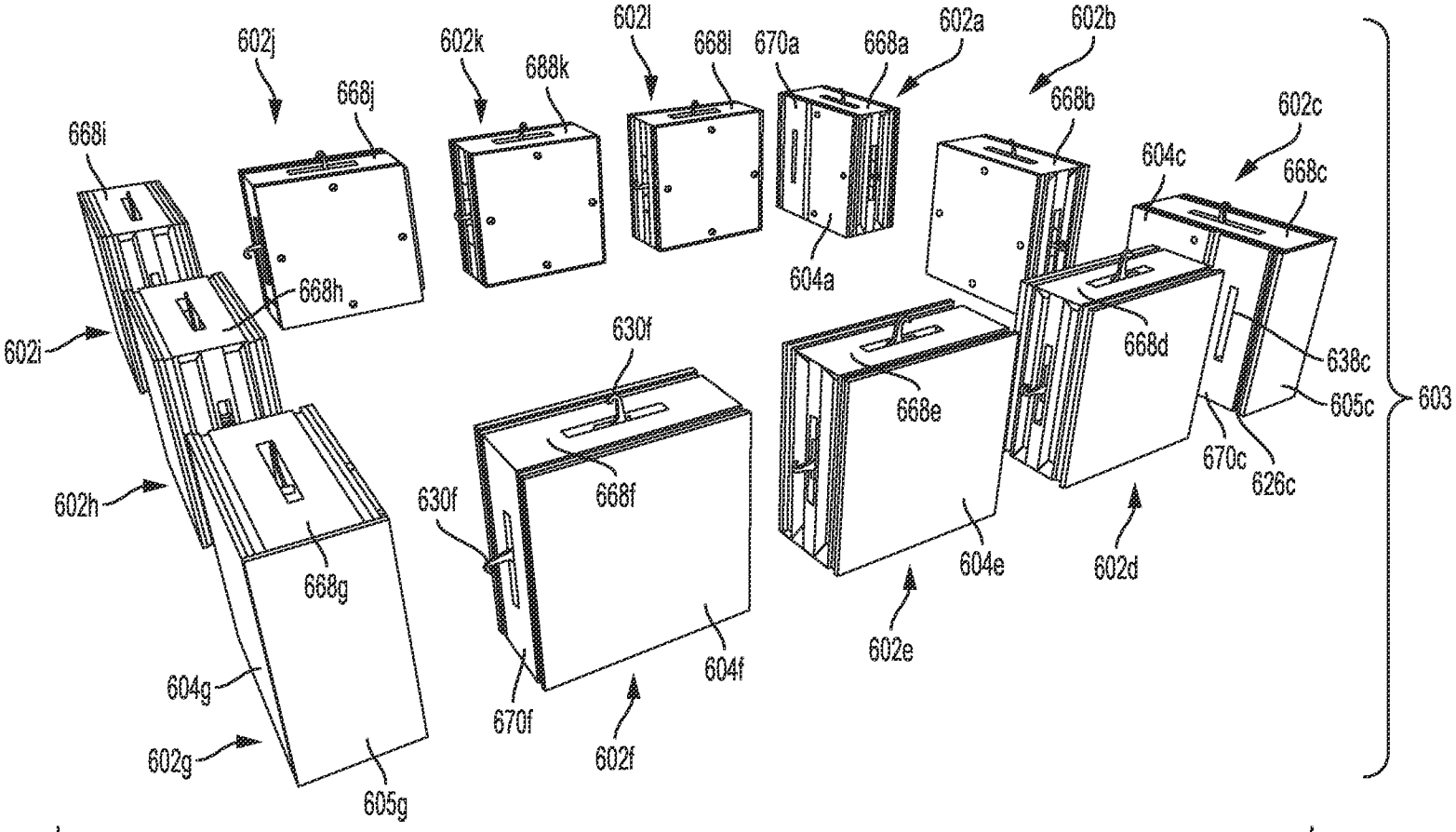
FIG. 31 shows a perspective view of several SIBUs to be joined into a structure or part of a building, according to an embodiment of the present invention.

FIG. 31 shows an exploded perspective view of a plurality of SIBUs 602*a*-6021 that can be coupled or attached to each other to form a section of four walls, according to an embodiment of the present invention. Similar to the embodiments discussed above, the SIBUs 602*a*-6021 in this configuration can be aligned and joined according to the features of splines, as well as cams, on adjoining surfaces of the SIBUs. In some embodiments, a spline may be provided without the projections or recesses of the other splines discussed above, resulting in a relatively flat joining surface. An example of such splines can be seen on the side of the SIBUs 602*a*, 602*c*, 602*f*, and 602*j* near each of the corners of the exploded wall in FIG. 31. In addition, the splines 668*a*-6681 on the top side of SIBUs 602*a*-6021 have relatively flat surfaces without the three-dimensional projections and recesses discussed above. Cams, adhesive, and seals may still be used to join such splines with relatively flat surfaces, such as cams 630*f* on SIBU 602*f* in FIG. 31. According to various aspects of embodiments, when the SIBUs 602*a*-6021 are coupled together, outer layers such as the first outer layers 604*e*, 604*f*, and 605*g*, can formed a continuous outer surface of a structure.

Figure 32:
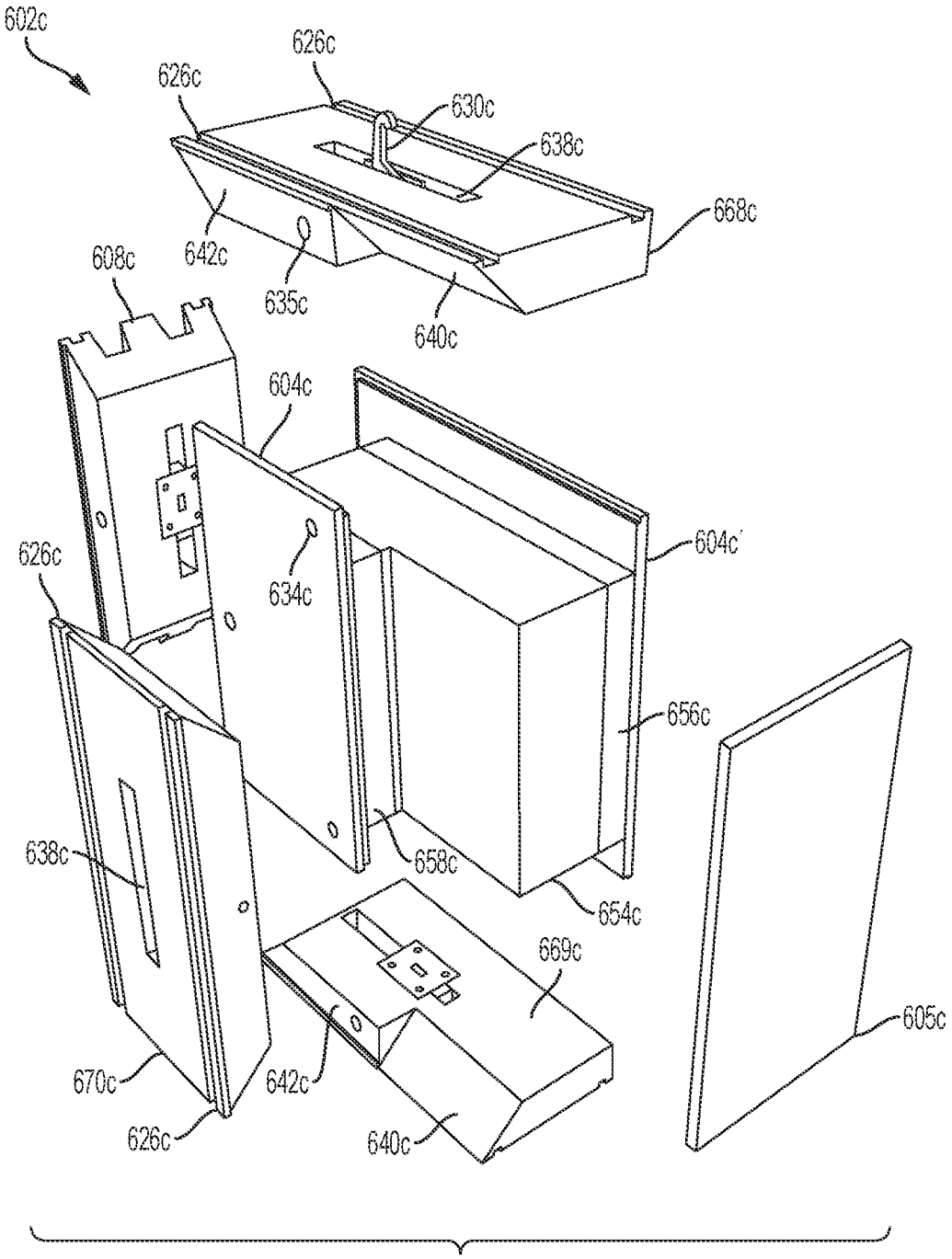
FIG. 32 shows an exploded perspective view of one of the SIBUs of FIG. 31, according to an embodiment of the present invention.

FIG. 32 shows an exploded perspective view of SIBU 602*c* near one of the corners of the exploded structure in FIG. 31. SIBU 602*c* has splines 668*c* and 670*c* that have a relatively flat surface. SIBU 602*c* has a composite core structure that includes an insulating core 654*c* and first and second foam concrete layers 656*c* and 658*c*. As discussed above, splines 668*c*, 670*c* may be provided with recesses 626*c* for seals and with cams 630*c* or cam chases 638*c* for holding adjacent SIBUs together. However, in some embodiments, these splines do not have the three-dimensional surface of projections or recesses discussed above. Such splines can be used, for example, at a junction of perpendicular SIBUs, as shown at the corners of the structure in FIG. 31, or on the top surfaces of SIBUs, also shown in FIG. 31. However, aspects of the invention are not limited to this embodiment, and the SIBUs and splines can be provided in any number of combinations of configurations. For example, splines with three-dimensional surfaces can be used on all or any combination of sides of the SIBUs, as the three-dimensional features can be used for precise alignment and greater structural integrity.

In some embodiments, additional modifications to splines or outer layers of a SIBU as possible based on the desired use or location of a SIBU within a structure. For example, the SIBU 602*c* in FIG. 32 is located at the corner of the wall section in FIG. 31. Thus, the SIBU 602*c* has three outer layers: a first outer layer 604*c*, a second outer layer 604*c*', and a third outer layer 605*c*. The second outer layers 604*c*' spans across an entire width of the SIBU 602*c*. However, the first outer layer 604*c* only spans a portion of the width of SIBU 602*c* because spline 670*c* is placed on the same face so that SIBU 602*c* can be coupled to SIBU 602*d*, which is shown in FIG. 31. The third outer layer 605*c* is provided on an edge of SIBU 602*c* so that a corner surface can be formed from the combination of the second and third outer layers 604*c*' and 605*c*. Because first outer layer 604*c* and spline 670*c* share a side of the SIBU 602*c*, splines 668*c* and 669*c* have longitudinal side surfaces with distinct sections. Specifically, splines 668*c* and 669*c* have inclined surfaces 640*c* for interfacing with the inclined end surfaces of spline 670*c*. In addition, splines 668*c* and 669*c* have side surfaces 642*c* to be disposed next to first outer layer 604*c*. Similar to embodiments discussed above, the side surface 642*c* can have an access hole 635*c* that aligns with access hole 634*c* of the first outer layer 604*c* when the SIBU 602*c* is assembled. The resulting access hole can be used to actuate cam 630*c*.

Figure 33:
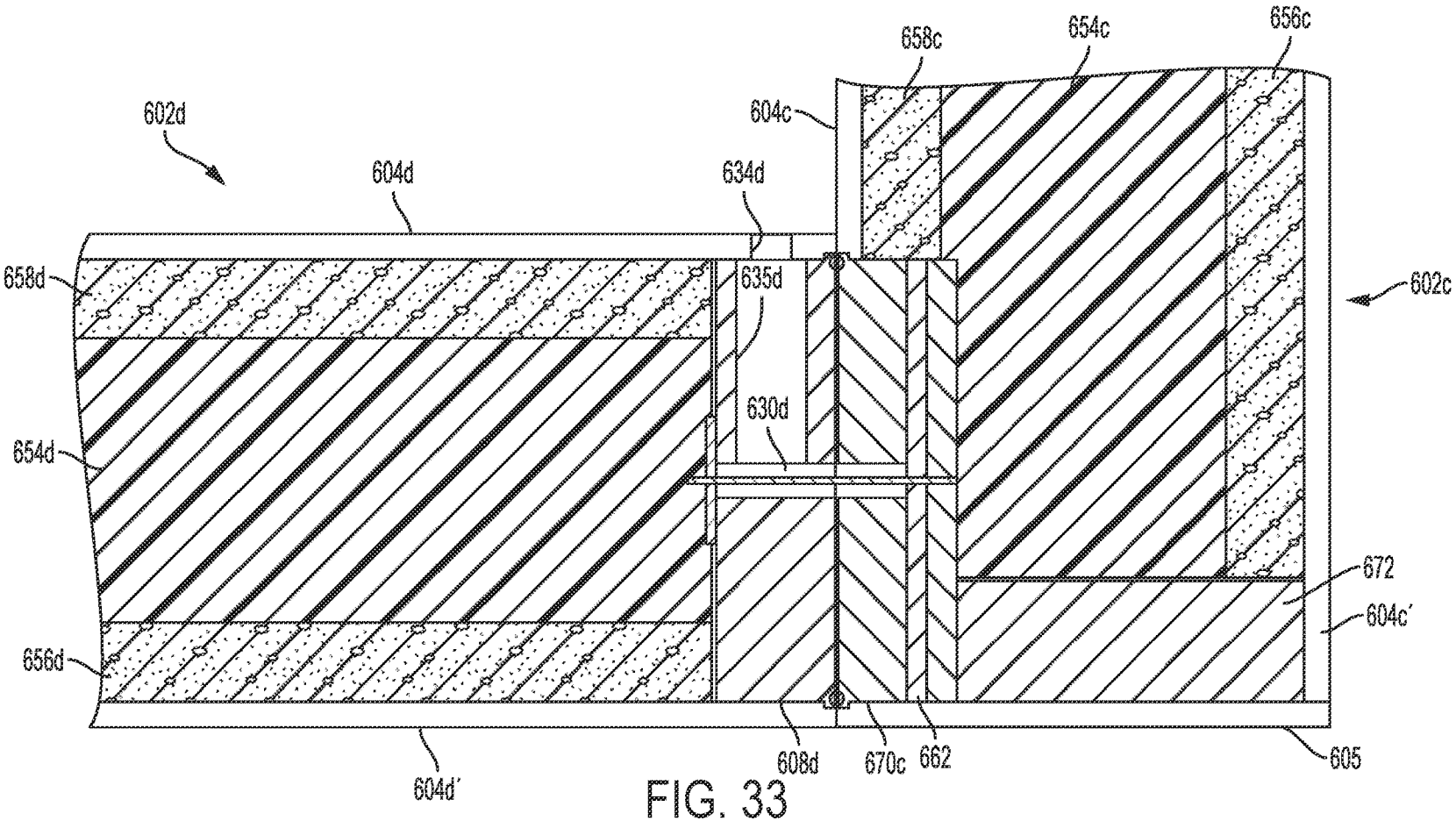
FIG. 33 shows a cross-section view of perpendicularly joined SIBUs, according to an embodiment of the present invention.

FIG. 33 shows a cross-section view of a joint between two SIBUs forming a corner of the structure shown in FIG. 31, according to an embodiment of the present invention. As shown, a seal and cam can be used even in the absence of the three-dimensional surface. Thus, a good alignment and tight seal between these two SIBUs can be achieved in the absence of the three-dimensional alignments that may be provided on additional SIBUs in the same structure. According to some embodiments, having a spline with a relatively flat coupling surface may make assembly of the structure easier depending on the configuration and order of assembly of the multiple SIBUs. In some preferred embodiments, however, three-dimensional surfaces, such as the projections and recesses discussed herein, may also be provided on splines at these corner junctions, for further improving alignment and structural integrity. Similar to arrangements discussed above, access holes 634*d* and 635*d* provide access to the cam 630*d*. Cam access holes can be provided on an interior or exterior of a structure. In some cases, after assembly of the structure, access holes can be patched with cement, plaster, putty, or other building material to close the hole. However, the access hole can also be left open without sacrificing the air- or water-tightness of the resulting structure, according to some embodiments.

Figure 34:
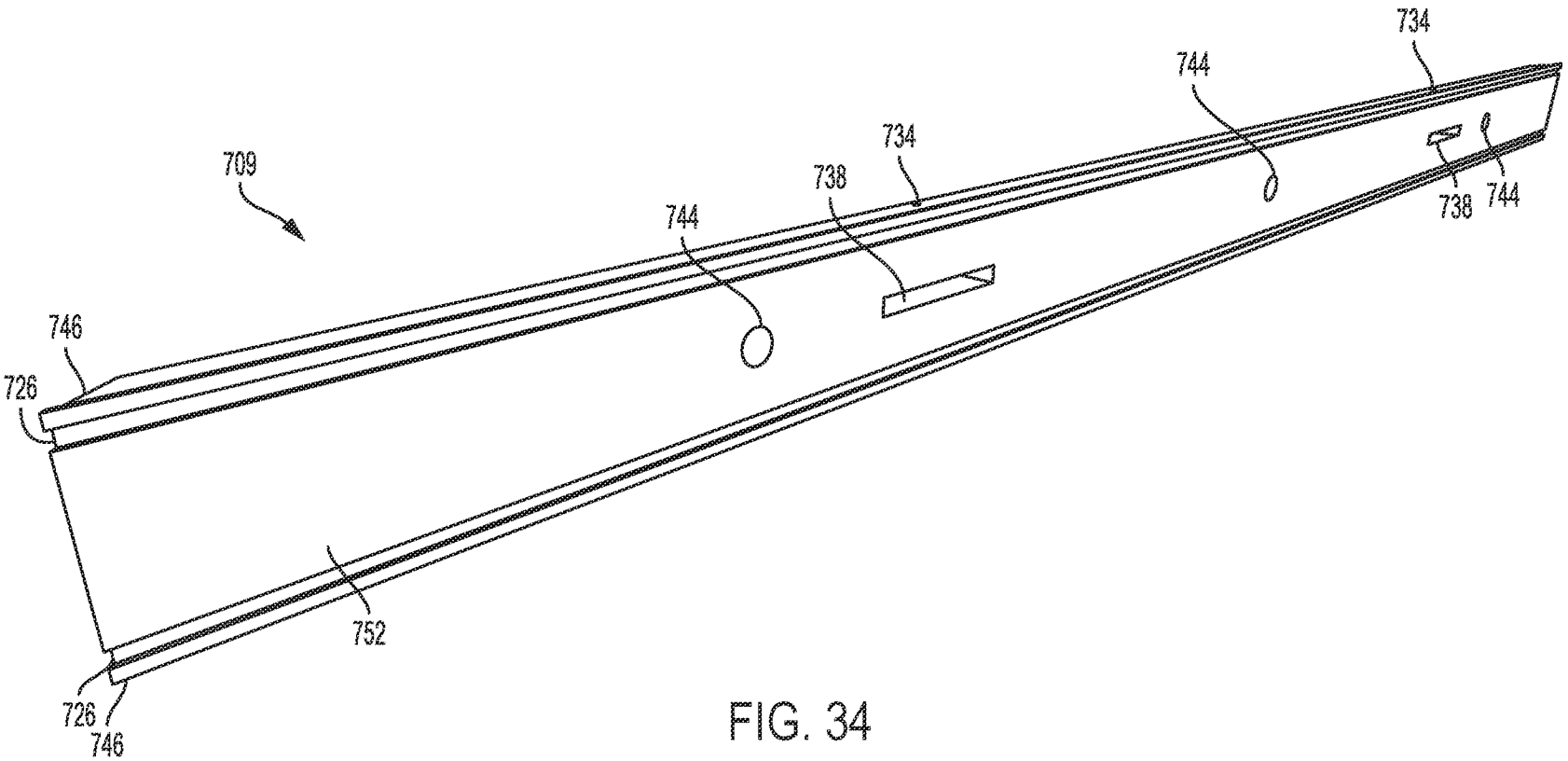
FIG. 34 shows a perspective view of a spline, according to an embodiment of the present invention.

FIG. 34 shows a perspective view of a spline 709, according to an embodiment where the spline 709 has a relatively flat surface. This is similar to the relatively-flat splines discussed above with respect to FIGS. 31-33, for example, but is shown in a longer form and has multiple cam chases 738 and electrical chases 744. The electrical chases 744 can be used for running electrical wiring or cable, or other utilities, through the structure. In some embodiments, splines can be formed by forming long splines, such as spline 709, which is then cut into sections of smaller splines. Alternatively, spline 709 can represent a long spline for use on the edge of a larger SIBU, as embodiments of the invention can be scaled to different sizes and shapes. FIG. 35 shows a front view of spline 709, FIG. 34 shows a plan view of spline 709, FIG. 35 shows a bottom view of spline 709, FIG. 36 shows a side view of spline 709, and FIG. 37 shows a close-up view of an end of spline 709 of FIG. 32. Spline 709 includes seal grooves 726 on a coupling surface 752, which is opposite to a mounting surface 750 for mounting spline 709 to a core of a SIBU. Flanges 746 are provided at a top of the inclined longitudinal walls 742 to align outer layers with spline 709. In addition, inclined end walls 740 are provided for aligning spline 709 with additional splines of a SIBU.

Figure 40:
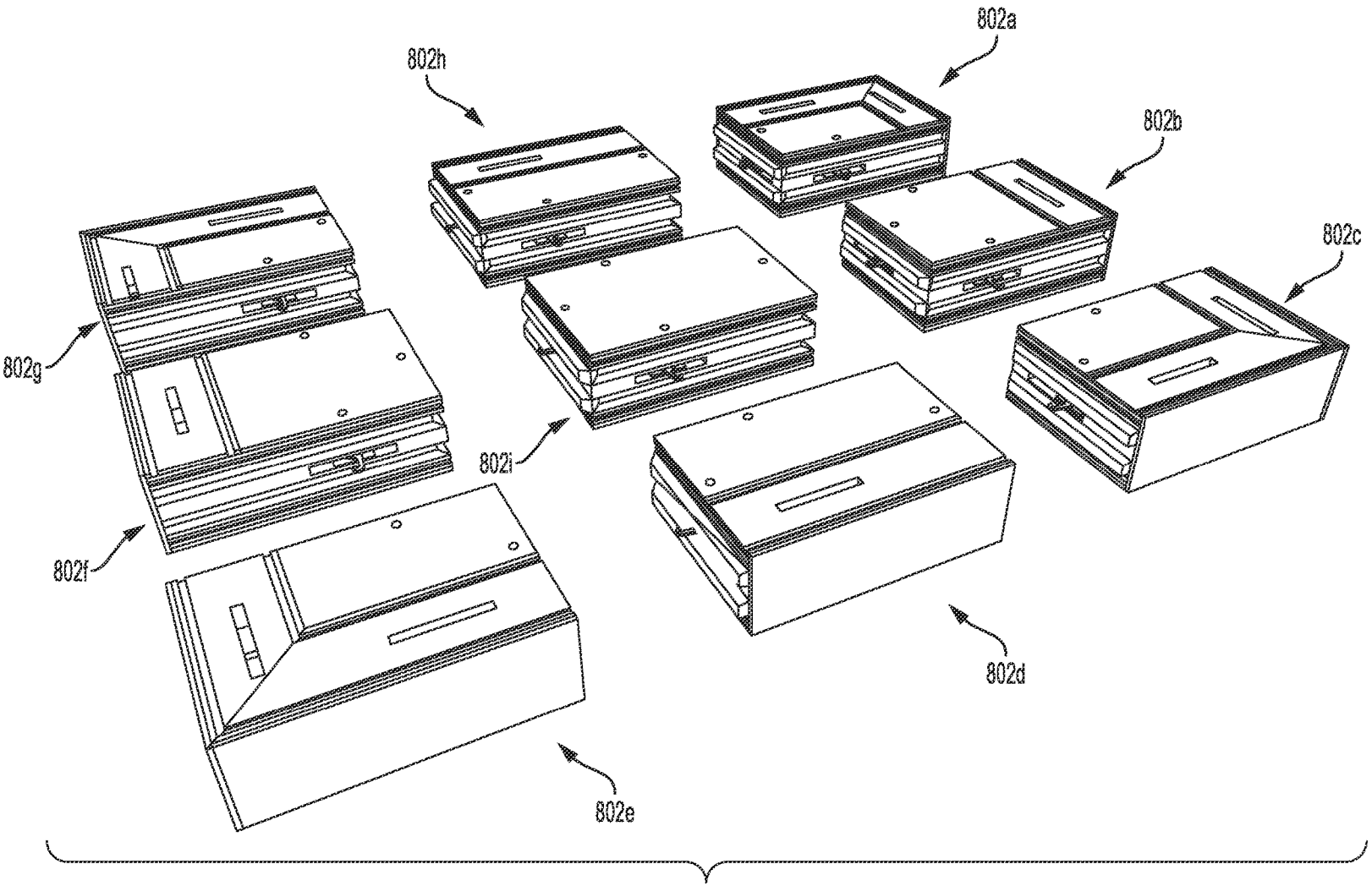
FIG. 40 shows a perspective view of several SIBUs to be joined into a structure, according to an embodiment of the present invention.

FIG. 40 shows an exploded perspective view of a plurality of SIBUs 802*a*-802*i* that together form a floor section of a structure, according to an embodiment of the present invention. A similar arrangement can also be used to form a ceiling section of a structure. According to some embodiments, SIBUs 802*a*-802*h*, which form the outer perimeter of the floor, have top surfaces that include outer layers and one or more splines. The outer layers will be the floor surface and can be provided with a prefinished surface in a number of finishes. For SIBUs 802*a*, 802*c*, 802*e*, and 802*g* located at the corners, two splines are provided on the top surface and walls can be placed onto those splines.

Figure 41:
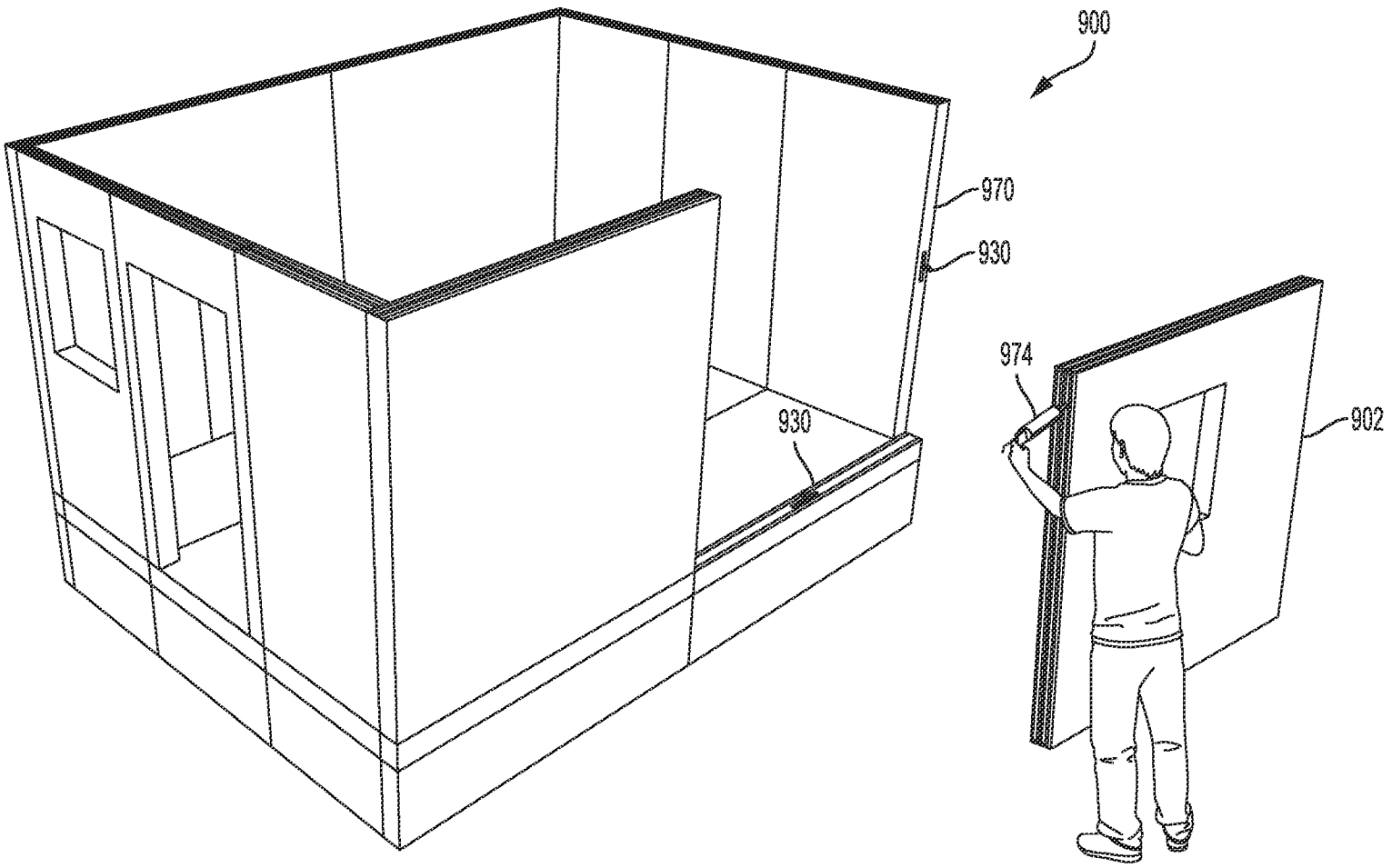
FIG. 41 shows an isometric view of a house being built using SIBUs, according to an embodiment of the present invention.
Figure 42:
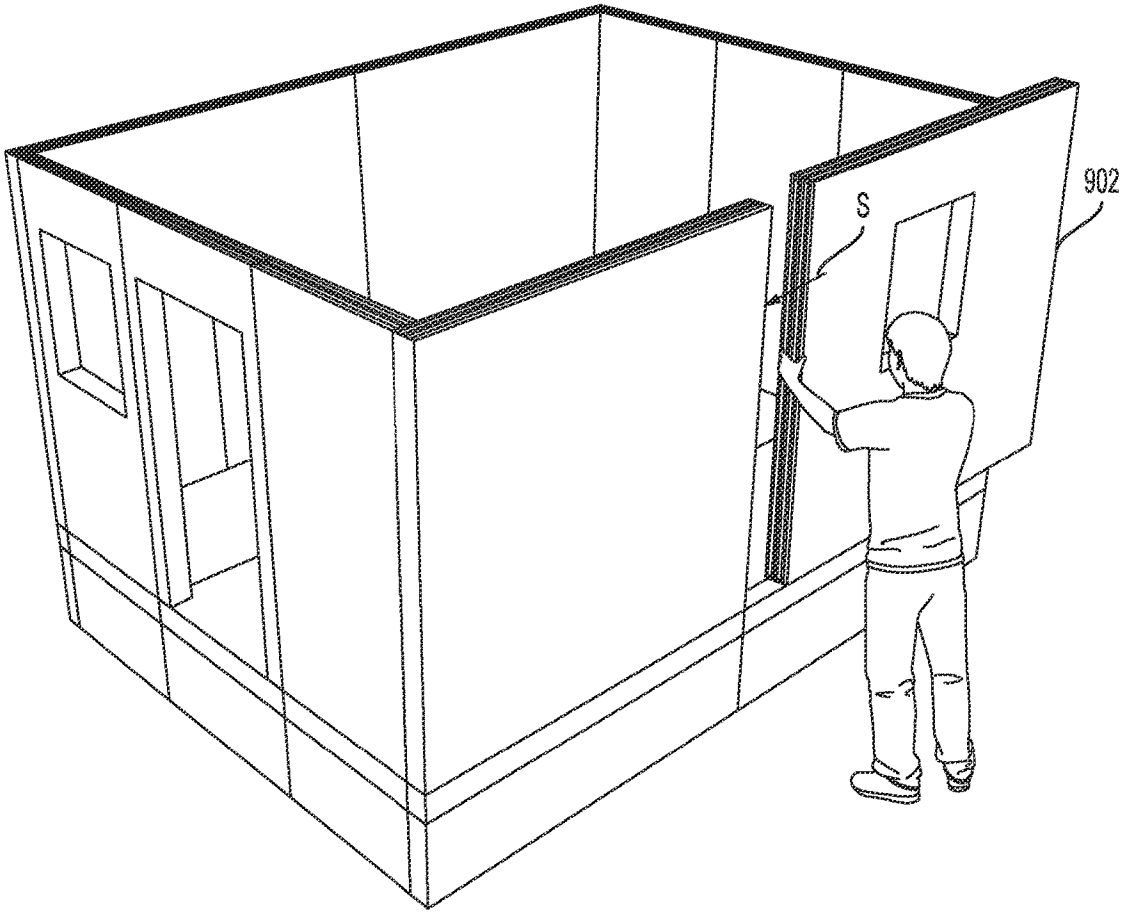
FIG. 42 shows the house of FIG. 41 as a SIBU is being put into position, according to an embodiment of the present invention.
Figure 43:
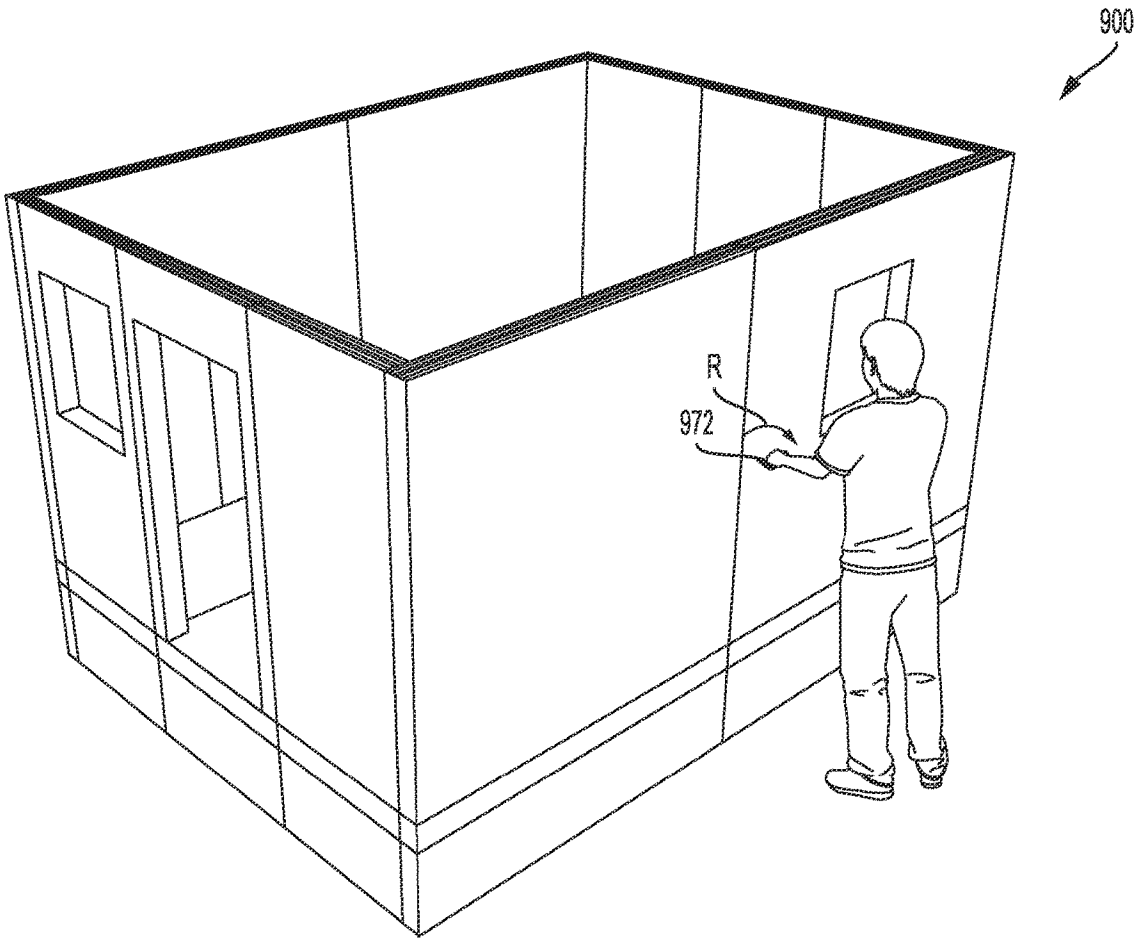
FIG. 43 shows the house of FIG. 41 after the SIBU has been joined and the cam is being activated by the user.

FIGS. 41-43 show a method of making a building using SIBUs and the resulting building, according to an embodiment of the present invention. FIG. 41 shows a near complete structure 900 similar to that shown in FIG. 1. A builder prepares a SIBU 902 to be the final panel of a wall of the structure 900. The SIBU 902 has a side surface with a spline having a three-dimensional surface. The builder applies an adhesive 974 to the spline of SIBU 902, before placing the SIBU 902 into the structure 900. Once in place, the SIBU 902 can be engaged by cams 930 at least while the adhesive dries. In FIG. 42, the builder has placed SIBU 902 into the structure, at which point SIBU 902 can be slid in direction S until the side spline of SIBU 902 comes into mating engagement with a spline (not shown) on the adjacent SIBU. In this embodiment, having a flat coupling surface on spline 970 of FIG. 41 can help make it easy to slide SIBU 902 in the direction of S. However, according to some embodiments, the spline 970 may be provided with three-dimensional alignment features that mate with complimentary features on a spline of SIBU 902.

According to aspects of embodiments of the invention, the method can include providing a plurality of structural insulated building units, each of the plurality of structural insulated building units including a first panel, a second panel, and a core between the first and second panels. The first and second panels can have first and second surfaces, respectively, that are prefinished. The method can further include placing the plurality of structural insulated building units in an arrangement next to each other such that the first panels of the plurality of structural insulated building units are adjacent to one another to form a first continuous surface, and the second panels of the plurality of structural insulated building units are adjacent to one another to form a second continuous surface. The first and second surfaces can be finished surfaces and no finishing of the first and second surfaces is needed after placing the plurality of structural insulated building units in the arrangement to form a building or structure. According to some embodiments, the step of placing can further include placing the structural insulating panels so at least one of the first and second panels is on at least one of an interior or exterior of the building or structure. In FIG. 43, the SIBU 902 is in place and a cam (not shown) within SIBU 902 is actuated by rotating a tool 972 inserted into SIBU 902 in a direction R. The structure 900 can be finished with a roof made of one or more SIBUs according to embodiments of the invention, or can be finished with other types of roofing known in the art.

According to another embodiment, a method of building construction includes providing a plurality of structural insulated building units, each of the plurality of structural insulated building units including a first panel, a second panel, and a core between the first and second panels. The method includes placing the plurality of structural insulated building units in an arrangement next to each other such that joining sections of the structural insulated building units are brought into close contact, and positioning the structural insulated building units in a final arrangement by allowing the structural insulated building units to self-align with each other using the novel features of the complimentary splines when engaged with each other along the joining sections. In some embodiments, the step of placing further includes placing the structural insulating panels so at least one of the first and second panels is on at least one of an interior or exterior of the building or structure.

According to embodiments of the invention, SIBUs of virtually any size and shape can be produced and used to construct buildings or structures. The SIBUs according to embodiments of the invention are capable of providing inherent structural integrity and support without the need for additional framing. In contrast, pre-existing SIBU systems require additional structural framing. In embodiments of the current invention, structural performance can be provided by fiber-reinforced panels and splines. For provided such structural performance, splines and panels may have flexural strength of at least 20 MPa. In some embodiments, the flexural strength is greater than 20 MPa. The panel can have a thickness of at least 6 mm. Further, the panel and splines can have a high Young's modulus typical of fiber-reinforced concretes. According to various embodiments, the SIBUs can sustain weight in transverse tension and vertical load.

In an example according to embodiments of the invention, a panel was tested for flexural strength of at least 20 MPa according to standards of ASTM D790 and C1185, using testing methods according to ASTM, C1186, and AC90, and resulting in a tested flexural strength of 22 MPa. A compressive strength test to a test specification of 65 MPa (+/−5 MPa) according to ASTM D695 using test methods ASTM C170 and C179 provided a test result of 65 MPa for the panel. Additional testing showed advantageous results in bacterial and fungal resistance, surface burning characteristics, stain resistance, and freeze/thaw resistance. For example, a panel passed testing for no growth of bacteria/fungi according to standard ASTM G21 using test methods ASTM G21 and G22, passed testing for 0-25 flame spread and 0-15 smoke development according to standard ASTM E84 and testing method ASTM EG227, passed stain resistance testing of past 16 hours according to ANSIZ 1246 and test method ASTM C650, and passed testing for no defects and R>0.80 according to standard C1185 using test method ASTM C1186. SIBUs and structures built from SIBUs according to embodiments discussed herein additionally have high seismic resistance.

"Prefinished" or "prefinished surface" can mean a surface of the type that is finished in advance. For example, prefinished can be the finishing of an outer layer of a SIBU before it is used, sold and/or distributed for end use. Prefinished can be the finishing of the panel before it is used in the building process. Prefinished can be of the type that when the panel is ready for use in construction to build a structure, no additional finishing is needed. According to some embodiments, the outer layers of a SIBU can include one or multiple layers, composites, conglomerations, etc. to achieve the prefinished surface. Prefinished can be with an interior prefinish and/or exterior prefinish that is prefinished in accordance with the principles of the structure being built. For example, the type of prefinished surface can be chosen from among multiple possible prefinishes at a design phase of the structure, or when ordering the SIBUs. Thus, interior and/or exterior finishes can be chosen in accordance with aesthetic or other design principles of the structure. Prefinished can be without the need for the application of additional materials to the panels. A prefinished panel for use in building a structure is contemplated in accordance with the principles of the invention. The prefinished interior can be the interior facing side of the panel. The prefinished interior can be finished with ceramic, paint, tiles, wood, textured or decorative concrete, etc. The prefinished exterior can be finished with exterior finishes of the type on the exterior of a building. In building a house, the prefinished panels can have interior finishes prefinished for kitchens, bathrooms, living areas, bedrooms, etc. The prefinished panels can have exteriors finished for exteriors such as ceramic, concrete, siding, wood, etc. The prefinished panels can also include hardware, furnishings, and appliances, including necessary utility hookups integrated into the prefinished panels. Thus, upon completion of positioning and connecting the various SIBUs, the building can be complete without requiring additional steps, including installation of finishes, appliances, or other furnishings. However, the types of finishes for prefinished interior and exterior surfaces are not limited to those listed here, and can include any conventional building materials. Once the prefinished panels are assembled, no additional finishes are needed. The prefinished panels can be used to build any type of structure, including, homes, hospitals, offices, residential structures, commercial structures, etc.

In accordance with the various embodiments of the invention discussed herein, it is possible to provide a system of SIBUs that can be used for constructing a building of any layout or configuration. For example, such system may include a certain number of distinct SIBUs that differ from one another in size, shape, and/or arrangement of splines. Accordingly, with a minimum or predetermined number of distinctly configured SIBUs provided in adequate numbers, SIBUs can be combined in various permutations to build any desired structure using only the minimum number of distinct SIBU configurations. Thus, in an embodiment, the system includes a plurality of SIBUs, each of which can include, for example, two parallel sides, four edges extending between the two sides, and at least one spline to connect the SIBU to a spline of another of the plurality of SIBUs. The plurality of SIBUs includes a base set of SIBUs that are differentiated from each other by an arrangement of at least one spline on each structural insulated building unit of the base set. In addition, the base set is designed such that buildings of numerous configurations can be constructed by joining different numbers and combinations of structural insulated building units of the base set.

Foamed Concrete Compositions

Embodiments of the present invention can include or make use of novel foamed cementitious compositions. Such compositions fiber-reinforced cement-based products having improved structural and performance characteristic. These fiber-reinforced cement-based products can incorporate a variety of different materials such as binders, rheology-modifying agents, and fibers to impart discrete yet synergistically related properties. The resultant composition is a light weight, insulating, fire resistant material that is rigid and structurally sound. Accordingly, the foamed cementitious compositions are capable of use in a variety of building products. Aspects of embodiments of the composition were previously described in U.S. Pat. Nos. 5,549,859; 5,618,341; 5,658,624; 5,849,155; 6,379,446; and U.S. Patent Application Publication Nos. 2010/0136269; 2011/0120349; 2012/0270971; 2012/0276310; and 2015/0239781, all of which are hereby incorporated reference in their entireties.

A product embodying the invention can be a lightweight, tough composite with excellent flexural and compressive strength that exhibits no warping or rotting. Additionally, the product can act as breathable membrane for moisture and condensation control in SIBUs. The invention is environmentally stable and non-toxic. The product embodying the invention is moisture and mold resistant, termite and insect resistant, and heat and rain resistant. These characteristics make the present invention an ideal building material with thermal and acoustic advantages, for example.

One embodiment of the present invention is a cast cementitious composite for use in building construction. The composition at a minimum can include fiber-reinforced cellular concrete made from a cementitious material. The composition may include, for example, fiber, rheology-modifying agents, a binder, and pozzolanic materials. In addition to these components, the cementitious compositions can be mixed with other additives and admixtures to give a foamed cementitious composite having the desired properties to the mixture and final article as described herein.

Testing was performed on some embodiments according to standard testing, including, for example, ASTM C796-12 and ASTM 495-12. The composition can form a member having one or more of the following characteristics in accordance with these ASTM standards: a density in the range of about 0.35 to about 1.0 g/cc; a flexural strength in the range of about 2-12 MPa; a flexural modulus in the range of about 2500 to 5500 MPa, and about 75% or greater of that in water immersion testing; a compressive strength in the range of about 4 to 10 MPa; able to pass about 2,000 hours or greater in accelerated weathering testing; 0 flame and 0 smoke surface burning characteristics; and insect and termite resistance. These properties are summarized in Table 1.

TABLE 1

Properties of fiber-reinforced foam concrete.

| Material Properties | | Test Result |
|---|---|---|
| Density | g/cc | 0.35-1.0 |
| Typical Flexural Strength | MPa | 2-12 |
| Typical Flexural Modulus | MPa | 2500-5500 |
| Water Immersion (Flexural Strength) | | >75% |
| Compressive Strength | MPa | 4-10 |
| Accelerated Weathering | P/F | Passed 2,000 hrs. |
| Surface Burning Characteristics | | 0 Flame/0 Smoke |
| Insect and Termite Resistant | Y/N | Yes |

More specifically, a preferred embodiment of the present invention may contain the following components in the given proportions by mass: cement 25 to 40%; acrylic fiber 0 to 5%; fly ash 10 to 20%; PVA fiber 1 to 5%; fumed silica 1 to 5%; fire clay 10 to 20%; gypsum 10 to 20%; and an acrylic binder 10 to 20%. The foregoing add up to 100 mass % of the non-aqueous components of the mix. These components are summarized in Table 2, along with a volume % of the various components.

TABLE 2

Composition of fiber-reinforced foam concrete.

| Material Component | Type | g/cc | Mass % Range | Volume % Range |
|---|---|---|---|---|
| Water 3 | Potable | 1.00 | 0.00 | 0.00 |
| Cement | Type II | 3.15 | 25-40 | 15-25 |
| Acrylic Fiber | 12 mm | 1.17 | 0-5 | 0-10 |
| Fly Ash | Class C | 2.60 | 10-20 | 10-20 |
| PVA | 6 mm | 1.30 | 1-5 | 2.5-5 |
| Silica | Fumed | 2.20 | 1-5 | 1-5 |
| Fire clay | Ground | 2.40 | 10-20 | 5-15 |
| Gypsum | Hemihydrate | 1.60 | 10-20 | 15-25 |
| Acrylic binder | Water based | 1.00 | 10-20 | 15-30 |
| Totals | | | 100.00 | 100.00 |

In this embodiment, Type II cement can be used. However, other cement types can be used to achieve the described desired properties.

Acrylic fibers of about 12 mm and PVA fibers of about 6 mm can be used in combination with each other or separately, and are substantially homogenously dispersed throughout the composition. The fibers act as a reinforcing component to specifically add tensile strength, flexibility, and toughness to the final article. As a result, structures formed from the fiber-reinforced concrete can fail in a non-catastrophic manner. Because the fibers are substantially homogenously dispersed, the final article does not separate or delaminate when exposed to moisture. Other types of fibers that provide the desired tensile strength, flexibility, toughness and resistance to delamination may also be used.

Fly ash and fumed silica are pozzolanic materials. In some embodiments, Class C fly ash is used. However, other types of fly ash and other similar pozzolans can be used to give the desired properties of the composition.

Fly ash and fire clay provide fire protection and act as rheology-modifying agents by enabling uniform dispersion of the mixture. Other compounds providing these properties may also be used.

Gypsum adds additional fire protection and increases the form-stability of the resultant foamed concrete. The gypsum can be of a hemihydrate type. Gypsum also acts as a rheology-modifying agent. Other hydraulically settable materials having these properties may also be used.

An acrylic binder disperses the powder particles of the mixture to create the paste structure during mixing and to maintain adequate levels of workability. Any acrylic binder that maintains these desired properties may be used. The acrylic binder can be water based.

The product embodying the invention is generally prepared by combining the cementitious mixture with a suitable foaming agent, creating a cured cementitious composite with well-dispersed and uniform pore size. The foaming agent aerates the cementitious composition so that it is light-weight while retaining its strength and rigidity. Either surfactant or polymer foaming agents are appropriate, with surfactant-based foaming agents preferred in some embodiments.

The well-dispersed and uniform pores create a matrix of foamed concrete that is light-weight due to a high percentage of air within the pores. According to an embodiment, the fiber-reinforced foam concrete can be, for example, 75% air. However, embodiments are not limited to this specific air ratio, and can have a smaller or larger percentage in some embodiments. The relatively high percentage of air, combined with the strength of the fiber-reinforced foam concrete, results in products with many advantages. For example, due to being light-weight, the products can be easier to transport or to handle by builders when erecting a structure using elements made of the fiber-reinforced foam concrete. In addition, the combination of light weight and high strength means that elements formed from the composition can be used in a large variety of ways within a structure, such as being used as parts of walls, floors, ceilings, roofs, doors, or other building features. The well-defined and evenly distributed pores also result in products that have very good performance in the face of moisture such as condensation or leaks within the products. For example, the pore network within the fiber-reinforced foam concrete can allow water to dissipate or spread out rather than pooling in one location, decreasing the changes of rot, bacterial/fungal growth, or damage from freezing and thawing of the water within the product.

An example of another embodiment of the current invention may contain the following components in ratios indicated by the relative masses shown: water 1.5 to 2.25 kg; cement 1.6 to 2.40 kg; fly ash 0.00 to 1.00 kg; type 100 tabular alumina 0.00 to 0.50 kg; type 325 tabular alumina 0.00 to 0.50 kg; sand 0.25 to 0.38 kg; silica 0.15 to 0.23 kg; fire clay 0.40 to 0.60 kg; gypsum 1.20 to 1.80 kg; glass fiber 0.08 to 0.13 kg; PVA fiber 0.02 to 0.03 kg; and rheology agent 0.00 to 0.10 kg. These components are summarized in Table 3, along with the mass in kg of the various components. The mass of the components is given to illustrate examples of relative proportions. However, the actual mass used in a mixture can vary according to the volume of the mixture.

TABLE 3

Example of composition of fiber-reinforced foam concrete

| Material Component | Type | Mass in kilograms |
|---|---|---|
| Water | Potable | 1.50-2.25 |
| Cement | CA-25 | 1.60-2.40 |
| Fly Ash | Class C | 0.00-1.00 |
| Tabular Alumina | Type 100 | 0.00-0.50 |
| Tabular Alumina | Type 325 | 0.00-0.50 |

TABLE 3-continued

Example of composition of fiber-reinforced foam concrete

| Material Component | Type | Mass in kilograms |
|---|---|---|
| Sand | SSC 710 | 0.25-0.38 |
| Silica | Silcosil | 0.15-0.23 |
| Fire Clay | Muddox | 0.40-0.60 |
| Gypsum | 90 min. | 1.20-1.80 |
| Glass Fiber | Advantex Type 30 (1 inch) | 0.08-0.13 |
| PVA Fiber | 8 mm fibers | 0.02-0.03 |
| Rheology Agent | Methylcellulose | 0.00-0.10 |

Aspects of embodiments of the invention incorporate fibers in a way that has not been done in previous reinforced foam concretes.

In an embodiment, a foamed concrete material for use in construction of buildings or structures includes a cement mixture, and a foaming agent. The cement mixture is fiber-reinforced, and the foamed concrete material is arranged as a porous foam structure having a fiber-reinforced matrix of the cement mixture with pores of air dispersed throughout the fiber-reinforced matrix. In one aspect of the embodiment, the foamed concrete material can be about 10% to 80% air by volume. In some embodiments, the foamed concrete material can be about 60% to 75% air by volume. While a high air volume ratio may have previously yielded weak concrete, embodiments of the current invention can have the above-described volume ratios of air while maintaining strength and structural integrity. Lower volume ratios of air result in heavier, less breathable, and, in terms of materials, more expensive concrete.

In some aspects of the embodiment, the foaming agent can be a polymer-based foaming agent or a surfactant-based foaming agent. In some examples, the cement mixture includes from about 25 to 40 percent by mass of cement; from about 10 to 20 percent by mass of fly ash; from about 1 to 5 percent by mass of polyvinyl alcohol fiber; from about 10 to 20 percent by mass of fire clay; from about 10 to 20 percent by mass of gypsum; and from about 10 to 20 percent by mass of acrylic binder. The cement mixture can further include from about 1 to 5 percent by mass of silica. For fiber reinforcement, the cement mixture can further include from about 0 to 5 percent by mass of acrylic fiber, in some embodiments. Embodiments can also include glass fibers for fiber-reinforcement. The type of fiber used can be tailored to different uses and needs. The cement mixture may also include water.

In some embodiments, fibers may be greater than 10 μm in diameter. The fibers are about 30 μm in diameter, in some preferred embodiments. However, embodiments are not limited to these specific diameters. According to embodiments of the invention, it is possible to achieve high-strength, structurally-sound fiber-reinforced foamed concrete with fibers at larger diameters than previously thought possible for uses contemplated herein that require strength and structural integrity. In some embodiments, fibers can be about 6 to 12 mm in length. The fibers can be about 10 to 20 percent by volume of the cement mixture. Embodiments of the invention can incorporate higher percentages of fiber than in previous reinforced foamed concretes while maintaining desired performance.

Multi-Layered Composite Building Elements

Some embodiments of the present invention relate to a multi-layered composite building elements for building construction and materials. Aspects of these embodiments can include integrated multi-layer units for constructing buildings and other structures. These units can include SIPs, but are not limited to SIPs. Some embodiments include any aspect or material of a building or structure have a multi-layered arrangement as disclosed herein.

In some preferred embodiments, the multi-layered composite building element includes an insulating core layer having first and second faces, and a cementitious sheet on each of the first and second faces. In some embodiments, the insulating core layer comprises foamed concrete. In some preferred embodiments, the insulating core layer includes an insulating foam layer in the middle of the insulating core, and a foamed concrete layer on each side of the insulating foam layer such that the foamed concrete layers comprise the first and second faces of the insulating core. The insulating foam layer can be a polymer-based foam, such as polystyrene foam or other foams suitable for use in constructing buildings and other structures. The foamed concrete layers can be made of fiber-reinforced foamed concrete in accordance of various embodiments discussed herein. The cementitious sheets may be fiber-reinforced concrete.

The addition of fiber-reinforced foamed concrete layers provides additional strength and stiffness to the multi-layered structure, while also providing enhanced thermal and noise insulation, and resistance to freeze/thaw damage and other problems associated with moisture. The fiber-reinforced foam concrete is relatively light for the strength and stiffness it provides, and can contain a high ratio of air within the cellular matrix of the foamed concrete. Thus, the above advantages achieved by the foamed concrete come at a relatively low cost in terms of weight and material expense.

In embodiment of the current invention, a multi-layered composite element for building structures can include an insulating core and first and second cementitious sheets. The insulating core includes a first face and a second face on an opposite side of the insulating core from the first face. The first and second cementitious sheets are on the first and second faces, respectively, of the insulating core, and the first and second cementitious sheets can comprise fiber-reinforced concrete. The insulating core further can include fiber-reinforced foamed concrete.

In some aspects of the embodiment, the insulating core includes a foam insulating layer as a center layer of the insulating core, a first foamed concrete layer on a first side of the foam insulating layer, and a second foamed concrete layer on a second side of the foam insulating layer. The first foamed concrete layer comprises the first face of the insulating core, and the second foamed concrete layer comprises the second face of the insulating core. The first and second foamed concrete layers can comprise fiber-reinforced foamed concrete, in some embodiments.

The foam insulating layer can be a polymer-based foam, and can include, for example, polystyrene foam. The foam insulating layer can affixed to the first and second foamed concrete layer via an adhesive, according to some embodiments.

Self-Sustaining Structures

According to various embodiments of the present invention, a building or structure made of SIBUs can be built to environmentally conscious standards. The resulting building can, for example, include solar panels placed on or within the structure. Solar panels can be placed on the roof or exterior walls of a completed structure built from SIBUs, or solar cells can be incorporated into the SIBUs themselves. Electricity can then be supplied to the structure via solar power with 12-Volt systems. In some embodiments, there may be no need for local utility hook ups to the structure, and the structures may be self-sufficient. As a result, strong, sustainable, efficient structures can be built quickly and economically.

Self-sustaining structures can be built using methods, systems, materials, and apparatus in accordance with various embodiments herein. In some embodiments, the SIBUs, multi-layered composite building elements, and materials and related methods according to embodiments of the invention can produce structural elements that have high R values (a measure of insulating ability) per unit thickness of the material or element. As a result of these high R values per unit thickness, high efficiency solar-powered systems, including HVAC through geothermal current and other electrical systems, can be powered through 12-volt DC current with low power consumption. In some embodiments, all electrical systems the structure can be powered through a 12-volt DC current. Because structures and materials according to embodiments of the invention are designed to meet or exceed applicable fire rating requirements, structures can be built without additional conduit or wiring protection, which reduces time and expense of the structures.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A structural insulated building unit for constructing a building or structure, the structural insulated building unit comprising:

an insulating core defined by a plurality of sides and opposing first and second faces of the insulating core, wherein the insulating core comprises a foam middle insulating layer and fiber-reinforced foam concrete outer layers which define the opposing first and second faces of the insulating core, wherein the fiber-reinforced foam concrete outer layers are formed of a foamed concrete material comprising fibers and pores of air dispersed throughout the foamed concrete material, wherein the fiber-reinforced foam concrete outer layers impart fire resistance and moisture control to the structural insulated building unit;

first and second structural cementitious panels coupled to the first and second faces of the insulating core, wherein the first and second structural cementitious panels provide structural integrity to the building or structure; and a connecting portion on one of the sides of the insulating core, the connecting portion being configured to align the structural insulated building unit with an adjacent structural insulated building unit having a complementary connecting portion when constructing a building or structure.

2. The structural insulated building unit of claim 1, wherein the connecting portion is a spline extending along the side of the insulating core, wherein the spline comprises a three-dimensional surface facing outward from the structural insulated building unit, the three-dimensional surface being configured for mating engagement with a three-dimensional surface on the complementary connecting portion of the adjacent structural insulated building unit, and wherein the mating engagement of the three-dimensional surface on the spline and the three-dimensional surface on the complementary connecting portion is configured to align the structural insulated building unit with the adjacent structural insulated building unit in three orthogonal directions parallel to x-, y-, and z-axes.

3. The structural insulated building unit of claim 2, wherein the spline further comprises:

a mounting side configured to couple to the side of the insulating core; and a coupling side on an opposite side of the connecting portion relative to the mounting side, the coupling side comprising the three-dimensional surface.

4. The structural insulated building unit of claim 3, wherein the structural insulated building unit is configured to accommodate at least one of an adhesive, a seal, and a gasket on at least a portion of the three-dimensional surface when in mating engagement with the adjacent structural insulated building unit.

5. The structural insulated building unit of claim 2, wherein the spline comprises:

a cam chase configured to allow a cam to extend between the structural insulated building unit and the adjacent structural insulated building unit, and an access hole through which the cam can be actuated for engaging or disengaging with one of the structural insulated building unit and the adjacent structural insulated building unit.

6. The structural insulated building unit of claim 2, wherein the three dimensional surface is configured to align the structural insulated building unit with the adjacent structural insulated building unit with precision such that the first and second structural cementitious panels of the structural insulated building unit and the adjacent structural insulated building unit form continuous planar surfaces across edges of adjacent first and second structural cementitious panels.

7. The structural insulated building unit of claim 1, wherein at least one of the first or second structural cementitious panels has a pre-finished surface that faces outward from the structural insulated building unit.

8. The structural insulated building unit of claim 7, wherein the at least one of the first or second structural cementitious panels comprises a fiber-reinforced concrete layer.

9. The structural insulated building unit of claim 1, wherein the structural insulated building unit is configured to be aligned and joined with the adjacent structural insulated building unit without screws or nails.

10. The structural insulated building unit of claim 9, the structural insulated building unit further comprising a cam with a hook, the cam being configured to hold, via the hook, the connecting portion in mating engagement with the complementary connecting portion.

11. The structural insulated building unit of claim 1, wherein the structural insulated building unit is air- and water-tight.

12. The structural insulated building unit of claim 1, wherein, when components of the structural insulated building unit comprising the insulating core with the foam middle insulating layer and fiber-reinforced foam concrete outer layers, the structural cementitious panels, and the connecting portion are assembled, the structural insulated building unit has a location precision between the components in the range of plus or minus one tenth of 1 mm and plus or minus 1 mm.

13. The structural insulated building unit of claim 1, wherein the fibers are present in an amount from about 10 to 20 percent by volume of the foamed concrete material.

14. The structural insulated building unit of claim 1, wherein the fiber-reinforced foam concrete outer layers have a density in the range from 0.35 to 1.0 g/cc.

15. The structural insulated building unit of claim 1, wherein the fiber-reinforced foam concrete outer layers have a flexural strength in the range from 2 to 12 MPa.

16. The structural insulated building unit of claim 1, wherein the fiber-reinforced foam concrete outer layers have a flexural modulus in the range from 2500 to 5500 MPa.

* * * * *